US009437356B2

(12) United States Patent
Krämer et al.

(10) Patent No.: US 9,437,356 B2
(45) Date of Patent: Sep. 6, 2016

(54) MEDIUM FREQUENCY TRANSFORMER

(71) Applicant: STS Spezial—Transformatoren—Stockach GmbH & Co. KG, Stockach (DE)

(72) Inventors: Wilhelm Krämer, Sandhausen (DE); Christoph Gulden, Bodman-Ludwigshafen (DE)

(73) Assignee: STS Spezial-Transformatoren-Stockach GmbH & Co. KG, Stockach (DE)

( * ) Notice: Subject to any disclaimer, the term of this patent is extended or adjusted under 35 U.S.C. 154(b) by 0 days.

(21) Appl. No.: 13/935,141

(22) Filed: Jul. 3, 2013

(65) Prior Publication Data

US 2014/0159846 A1 Jun. 12, 2014

(30) Foreign Application Priority Data

Aug. 10, 2012 (EP) ..... 12005803

(51) Int. Cl.

| | |
|---|---|
| ***H01F 27/02*** | (2006.01) |
| ***H01F 5/06*** | (2006.01) |
| ***H01F 27/08*** | (2006.01) |
| ***H01F 27/10*** | (2006.01) |
| ***H01F 27/06*** | (2006.01) |
| ***H01F 27/32*** | (2006.01) |
| ***H01F 30/10*** | (2006.01) |

(52) U.S. Cl.

CPC ..... *H01F 5/06* (2013.01); *H01F 27/02* (2013.01); *H01F 27/06* (2013.01); *H01F 27/08* (2013.01); *H01F 27/10* (2013.01); *H01F 27/321* (2013.01); *H01F 30/10* (2013.01)

(58) Field of Classification Search

CPC ..... H01F 5/00; H01F 27/00–27/30
USPC ..... 336/65, 83, 90, 96, 180–184, 55–62
See application file for complete search history.

(56) References Cited

U.S. PATENT DOCUMENTS

| | | | | |
|---|---|---|---|---|
| 2,339,625 | A | 1/1944 | De Blieux | |
| 3,299,383 | A * | 1/1967 | Conner et al. | 336/60 |
| 3,525,908 | A * | 8/1970 | Allmendinger | 361/270 |

(Continued)

FOREIGN PATENT DOCUMENTS

| | | |
|---|---|---|
| EP | 0 710 965 | 5/1996 |
| EP | 1344230 B1 | 11/2004 |

(Continued)

*Primary Examiner* — Tuyen Nguyen
(74) *Attorney, Agent, or Firm* — Faegre Baker Daniels LLP

(57) ABSTRACT

The invention concerns a medium frequency transformer with a housing, in which numerous winding chambers, having primary and secondary windings, are disposed, wherein the housing is filled, at least partially, with an insulating liquid. The transformer is distinguished in that numerous winding chambers, filled with the insulating liquid, are disposed in the housing, and at least one winding is disposed in each winding chamber, such that, for the most part, only the windings are surrounded by the insulating medium. Preferably the winding chambers are sealed and separated from one another by means of insulating separating walls, wherein the windings are positioned and fixed in place in the winding chambers, and the winding chambers are filled with the insulating liquid. Between the windings there are thus, according to the invention, at least two insulating barriers, which function simultaneously and consist of solid matter insulation in the form of housing and separating walls, and the insulating liquid.

27 Claims, 18 Drawing Sheets

(56) References Cited

U.S. PATENT DOCUMENTS

Figure 1:
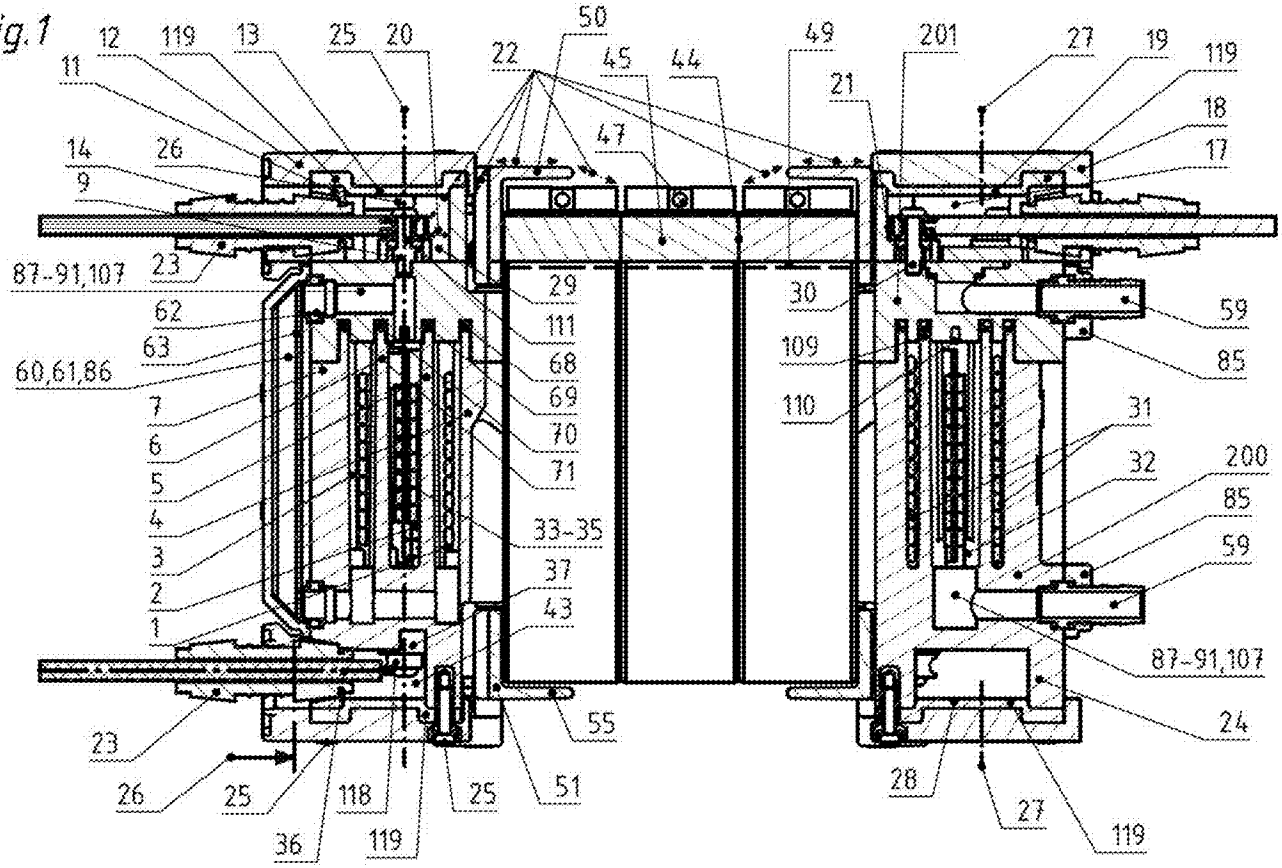

| | | | | |
|---|---|---|---|---|
| 3,710,002 | A * | 1/1973 | Link | 174/18 |
| 3,825,148 | A * | 7/1974 | Hunter et al. | 220/359.1 |
| 3,886,434 | A | 5/1975 | Schreiner | |
| 2008/0041612 | A1 | 2/2008 | Negle et al. | |

FOREIGN PATENT DOCUMENTS

| | | | |
|---|---|---|---|
| JP | 56-107538 | | 8/1981 |
| JP | 62-170618 | | 10/1987 |
| JP | 63-128613 | | 6/1988 |
| JP | 01-123407 | | 5/1989 |
| JP | 35-8324 | | 4/1991 |
| JP | 06-176942 | | 6/1994 |
| JP | 08-124757 | | 5/1996 |
| JP | 8-124757 | A | 5/1996 |
| JP | 08-138953 | | 5/1996 |
| JP | 2000-299233 | | 10/2000 |
| JP | 2002-033219 | | 1/2002 |
| JP | 2002-033219 | A | 1/2002 |
| JP | 2008-098226 | | 4/2008 |
| JP | 2008-520074 | | 6/2008 |
| JP | 2010-003931 | | 1/2010 |
| JP | 2010-003931 | A | 1/2010 |

* cited by examiner 37
74
15
42
37
74

8
76

59
85
76

64
73
114
1
2
3
7
6
5
4

85
76

37
74
42
37
74

102

59
85
200

64
96
73
114
1
2
7
64
3
5
6
4

85
C
C

76

1
2
3
4
5
6
7
68
69
70
71
124
121
41
201
59
63
200
62
60
87-90
38
30
9
72
92
31
130
129
115

126
132
131
Fig. 12 single
HV
LV
26
36
200,201
134
133
126

Fig. 10G
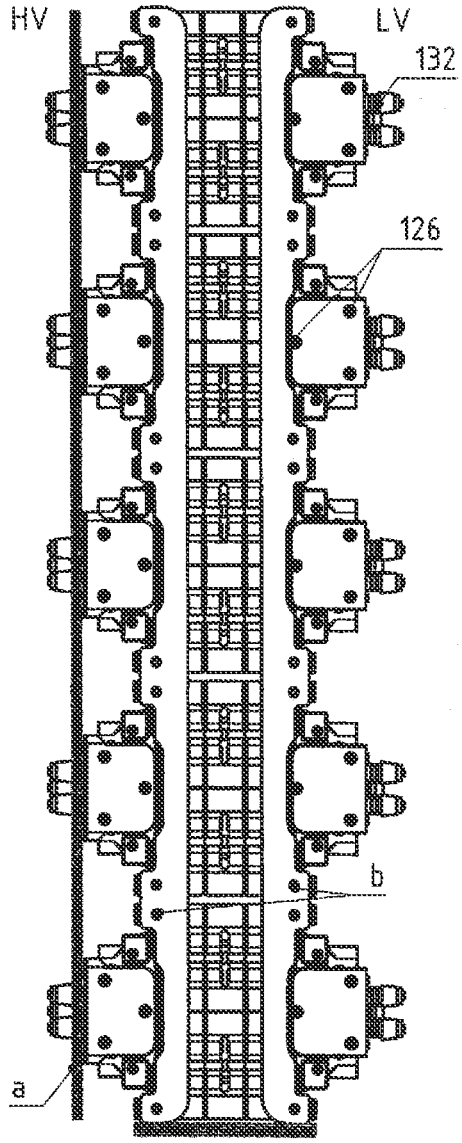
Fig. 10H
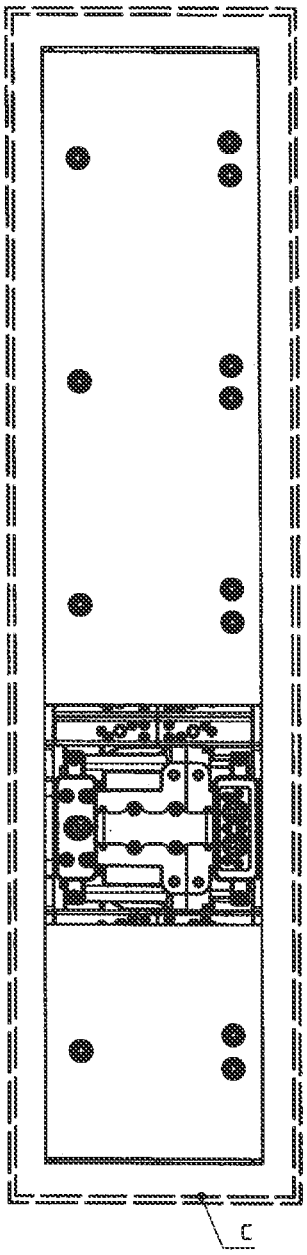
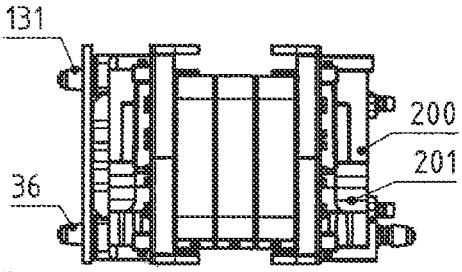
Fig. 10I

MEDIUM FREQUENCY TRANSFORMER

CROSS-REFERENCE TO RELATED APPLICATIONS

This application is related to and claims the benefit under 35 U.S.C. §119 to European Patent Application No. 12 005 803 filed Aug. 10, 2012, the entire disclosure of which is hereby explicitly incorporated by reference herein.

FIELD OF THE INVENTION

The invention concerns a medium frequency transformer (MF-transformer), for converter-transformations, for example, in the railway field, for transforming the typical overhead line voltages from 15 kV, 25 kV, 16⅔ Hz and 25 kV 50 Hz to DC link voltages of 1.8-3.6 kV. Naturally, an MF-transformer of this type is also suited for other applications.

PRIOR ART

It can be assumed that MF-transformers in transformation converters, with power electronics developed for them, are connected in series on the primary side, and connected in parallel on the secondary side.

With this MF-transformer technology, the weight and volume of conventional transformers can be significantly reduced. Furthermore, there is the possibility of transforming different voltages and frequencies if the MF-transformer-converter is configured for the higher and different operating voltages.

Converter transformations open up the possibility of installing drives in conventional trains and carriages which are still run on AC voltages in railway engines. This enables energy savings of up to 40%.

On the other hand, it is also possible to install transformation converters in railway engines and high-speed trains, because with this transformer technology, it is possible to pass through national or system borders having different voltages and frequencies.

The framework data for this transformer technology are 15.25-25 kV for operational voltage and 125-170 kV for surge voltage, or 48-72 kV for test AC voltage.

These operational and test voltages exceed the prior normal voltages for MF power transformers to a considerable degree. This means that normally, voltages for operational or test voltages of 3-6 kV are rarely exceeded for MF transformers—even with comparably lower power outputs. Power transformations above 80 kVA at 15-25 kV operational voltages would be uncommon in this sector.

This means that the data for this type of MF transformer requires new, previously unconventional technologies and designs.

In addition, there are high demands for low leakage inductances, in order that condenser capacities and weights for the needed oscillator and resonance circuits are kept as low as possible.

In the framework of the present invention, this leads to MF transformers and concepts of a type that are not yet known. In a substantial part of these developments, opposing technical physical requirements must be given an acceptable common denominator.

Moreover, the electrical losses of these MF transformers must be kept low, in order that the overall efficiencies of the actual converter transformation, consisting of a series of MF transformers with downstream converters, are higher than previously normal 16⅔ Hz or 50 Hz transformers with quadrant choppers and converter configurations.

An MF transformer for 15-25 kV and 8-11 kHz is known from EP 1 344 230 B1, the insulation of which, between the primary and secondary windings, is made of mica and epoxy resin casting compound.

The disadvantage, not only with this MF transformer, is that insulations made of solids for obtaining lower leakage inductances between the primary and secondary windings must be designed as very thin walls. Furthermore, these types of insulation cannot contain any air pockets, which can only be obtained with a great degree of difficulty and expenditure.

With the aforementioned MF solid state transformer, the primary and secondary windings are carried out in rectangular hollow tubes, which have unequal expansion coefficients for the insulation. Even when it is possible to produce layered insulation and/or casting substances without hollow pockets, and which are acceptable in terms of their partial discharge performance (PD performance), the question remains of how long a transformer of this type will continue to function.

With solid insulations, following the initial inspection for the production, there is still a chance that massive rigid hollow conductors will delaminate from the intermediate or ground insulations. This can also occur long after the initial start-up of the transformer. By way of example, increasing PD values may lead to conductive carbon tunnels, or "tree-branching channels" between the primary and secondary winding insulations.

With lower operational voltages, e.g. between 3-6 kV, the chance of a tunnel or branching channel formation, or PD thermal disruption, is relatively low, because the field strengths and PD intensities in the hollow spaces are usually not high, and not sufficient for the formation of conductivity in the form of a conductive tunnel formation in the insulation.

With MF transformers having 15-25 kV operational voltage, the relationships are fundamentally different. Significantly higher field strengths prevail in the insulations between the primary and secondary windings in comparison with typical MF transformers.

Minimal hollow spaces or delamination, which may also occur years after the initial start-up, are already sufficient for enabling unacceptable PD values to occur, with progressive routing tunnel formations at these voltages.

In addition, in the case of a disruptive discharge, high short-circuit capacities occur, whereby, with occurrences of this type, the high short-circuit capacity can be transferred from the overhead line to the drive region, or the power electronics of the converter. Significant damage can occur as a result of short-circuit transfers of this type. Primarily for these reasons, a permanent electrical safety for MF power transformers of this type is of the greatest importance.

Hollow conductors made of aluminum or copper, as are preferred in EP 1344230 B1, exhibit higher losses in comparison with MF strands, usually having high specific current strengths, which must be discharged in the form of heat, requiring coolers of corresponding sizes. With the use of hollow conductors made of copper or aluminum in MF transformers, the heat losses are usually dissipated by means of a flow of pure water through very narrow and long tubes, whereby the additional disadvantage of transformers of this type is the current displacement losses and eddy current losses in the winding conductors. More important, however, is the difference in insulation to previously standard MF transformers.

Another MF transformer with a coaxial winding configuration is disclosed in EP 0874371 A2. The disadvantages of an MF transformer with a coaxial winding in a planar design are determined by the system: relatively high power losses, at best, unilateral liquid cooling, difficult insulation between the coaxial conductors. Another disclosure of MF transformers can be derived from the article "Kleiner, leichter, efficienter" [trans.: "Smaller, Lighter, More Efficient"] in the ABB-Wissenschafts-Zeitschrift [trans.: ABB-scientific journal] ABB-Technik [trans.: ABB-Technology] 1/12 on pages 11 ff. This apparently concerns MF transformers conceived according to the model for typical oil transformers, meaning the primary and secondary windings are on intermediate insulation layers with oil gaps, in oil containers, which accommodate the required number of MF transformers. This has numerous disadvantages.

The necessity for a stable, relatively thick-walled, and thus heavier, oil container, which, although it is lighter than in conventional 1643 or 50 Hz transformers, is, however, furthermore equipped with a greater quantity of oil, because these transformers are also filled with oil outside of the windings and cores that have intermediate spaces. In comparison with the MF transformer ensemble according to the invention, this is heavier and more voluminous by a factor of 50 in terms of the transformer oil/ester ratio and in terms of the necessary volumes and weights, is heavier and more voluminous by a factor of 2-3.

DESCRIPTION OF THE INVENTION

For this reason, the primary intention and objective of the invention is to create a medium frequency transformer, in which all of the aforementioned disadvantages of the known MF transformers can be avoided. An extremely reliable, durable and compact MF transformer, with a high transference performance is to be created, which is particularly suited for 15-25 kV voltage and 16⅔, or 50 Hz, as well as AC voltages, which also has a significantly lower fire load in the framework of the combination with transformation converter volumes and the use of lighter and less liquid.

This objective is attained by means of a medium frequency transformer having the attributes given in claim 1.

Preferred designs of the invention and further advantageous attributes are given in the dependent Claims.

The described medium frequency transformer comprises a housing made of an insulating material, in which numerous windings are disposed, wherein the housing is at least partially filled with an insulating liquid medium.

The invention is distinguished in that numerous winding chambers are disposed in the housing, which are filled with the insulating medium, and at least one winding is disposed in each winding chamber, such that basically only the windings are surrounded by the insulating medium liquid.

Preferably, the winding chambers are sealed and separated from one another by means of insulating separating walls, as well as "floors" and "lids." The windings are positioned in the winding chambers, and secured therein, and the winding chambers are completely filled with the insulating liquid.

According to the invention, closed winding chambers are provided, made, for example, of casting resin, whereas the windings, preferably MF strand windings 31-32, are first deployed after the housing components have been produced. The invention and the technical advancement is seen, in particular, as being that not the entire MF transformer, core, etc. is filled and surrounded with the insulating liquid, as has been the practice in the prior art so far, but only the windings of the transformer are surrounded by the insulating liquid medium. The winding chambers are designed such that the insulating liquid only encompasses and flows around the windings. An additional housing, made of metal for example, which represents a liquid container in which one or more MF transformers submerged in liquid are accommodated, is not necessary.

The main advantage of the invention is that the required quantity of insulating liquid can be drastically reduced in comparison with the previously known transformers filled with insulating liquid. The quantity of required insulating liquid, according to the invention, amounts to, at most, 1-2% of the quantity required for a conventional MF transformer, submerged in a container.

As a result of the closed winding chambers filled with the insulating liquid, the windings are always electrically insulated from the other parts of the transformer by means of two independent insulation barriers, these being, firstly, the separating walls made of solid matter, and secondly, the insulating liquid.

The windings are placed in the winding chambers independently of their production, in order that "trapped air" or gas pocket formation is prevented at any cost in the winding. The winding chambers are then filled with an insulating liquid, such as ester 87, transformer oil, 88, doped pure water 89, cooling agent 90, or capacitor insulation oil 91, or a gas. Any air pockets in a liquid medium can be removed by means of vacuum methods and air separators in the liquid circulation. At appropriate pressures and adapted voltages, insulating gases, such as sulfur hexafluoride, $SF_6$, or various cooling agents and increased air pressure, are also possible.

Problems in the form of delamination, gaps and hollow spaces, which occur with solid matter insulations, are eliminated, because the windings are surrounded by insulating oil, ester, or pure water, substantially without air pockets.

Naturally, the requirements for conventional transformers having, e.g. 15.25 or 25 kV operational voltage, established in accordance with the IEC and VDE, must at least be fulfilled.

The advantage of a continuous configured series insulation surrounding the windings is that the liquid insulations in the form of esters, oils, doped pure water or gas are suitable for an effective insulation and heat dissipation from the MF strands and windings, as well as bushings and connections.

It is clear from the preceding that new technological demands could be formulated for transformation converters with MF transformers that go beyond the IEC voltage requirements, while, for a low leakage inductance between the primary and secondary windings 31, 32, however, optional secondary windings—e.g. converter windings [trans. note: GU-windings in the German text], are also possible. For insulating purposes, small spacings between the primary and secondary windings, on the one hand, and the lowest possible number of turns in the windings, on the other hand, are provided for. This results in a new MF transformer category, with regard to low leakage inductances as well, as is described herein.

MF transformers for 15.25 kV, for example, have become known from the prior art in which the intermediate insulations between the primary and secondary windings are conventionally produced from mica, casting resin or other insulating materials. These types of solid matter insulation present a possibility for building MF transformers operated at between 15-25 kV. It is, however, extremely difficult with conventional technologies to implement consistently low PD values, e.g. threshold values of less than 15 pC. This is due, in part, to the rigid conductors in the transformer casting compound, even when de-energizing padding measures are carried out. After the hardening of the resin, significantly differing expansions, as well as shrinkages, continue to act on the windings, layered insulations, and casting compound. And, although these MF transformers can be operated at between −30° C. and +140° C., numerous mechanical alternating loads can occur during the e.g. 30-50 years of operation.

It is known that intermediate insulations, made of, e.g. mica in the form of minimized spacings between the primary and secondary windings, with the inclusion of air or gas pores, or gaps, tend to exhibit partial discharges (PD). This is because windings with and without layered solid matter insulation are nearly impossible to produce without air pockets and pores. Furthermore, there is always a risk with these winding insulations, because there are no "self restoring" characteristics present, as is the case with capacitors submerged in liquid insulation, for example. Even if conventional solid matter insulations are void of hollow spaces, and can be produced so as to be acceptable with respect to the partial discharge, delamination from the rigid conductors may occur during later operation, thus resulting in increasing PI) intensities, or later in electrical disruptive discharges.

The first MF high performance, or traction transformers contained copper or aluminum rectangular tubes as a winding for, e.g. pure water cooling. Despite elaborate winding and buffering techniques, conductor delamination and gap formation from and in the insulation must always be expected. In addition, significantly higher power losses occur, of more than 3-4%, for example, than with windings made of MF or HF strand conductors, which can be cooled "from the outside," if accordingly sealed and nested chambers are present, as is the case with the transformer described herein.

The strand windings surrounded by insulating liquid (fluid), such as are used in the invention, are substantially PD resistant, because the insulating liquid (fluid) is continuously exchanged and/or cleaned and filtered. Because the windings are located in closed solid matter chambers P 1-3, lint or other impurities cannot accumulate between the beginnings and ends of the windings—as is the case with conventional oil transformers—and result in low voltage surges between the primary and secondary windings 32, 31, or against the ground, e.g. the core, P 45.

In addition, there is the fact that strand windings P92 are significantly less problematic in terms of their production than tubes, which are difficult to bend during the winding process, and are also otherwise are difficult to work with.

Preferably the primary/secondary windings 31, 32, 33 are nested, in order to reduce losses. The windings themselves preferably consist of MF strands or HF strands.

Currently typical solid matter insulations, similar to the 50 Hz converter technology, between 10 and 36 kV, are compared with an insulation system according to the invention, in which the separation of the high-voltage (HV) and the low-voltage (LV) ranges, and windings made entirely of solid matter and liquid insulation, result in a significant increase in the reliability, the voltages, and the performance of transformers of this type. Differences between liquid insulating media, such as ester, transformer oil, or pure water doping, consist substantially of different dielectric constants, which are approx. 3-4 with transformer oil, 50-100 with pure water, depending on the doping, 1 with air, and ca. 3 with $SF_6$, as well as disruptive discharge voltages, viscosities and the ignition temperature, which is, for example, significantly higher with esters than with transformer oil. In addition, non-hazardous biological degradability is also a consideration, which is of primary importance with esters. Accordingly, ester is the preferred intermediate insulation, with an insulating liquid, because in this case, deionizing cartridges etc. are not needed. Alternatives are pressurized air, $SF_6$ and cooling agent gases, which can only be considered for special applications.

Thus, it is also the case that, for example, ester-liquid insulations assume significantly higher voltage portions during nominal operation and during the voltage test. Conversely, the voltage portions that are to be assumed for the solid matter insulation of a transformer in this regard, with the liquid pure water doped with glycol, are significantly higher.

According to the invention, particularly for lower voltages, electro-negative gases, such as sulfur hexafluoride ($SF_6$) at a higher pressure, as well as, e.g., air or nitrogen, can also be used as the insulating liquid media, although these can only be considered, as mentioned above, for special applications.

In the following, the invention shall be described in greater detail, in reference to the drawings. Further attributes and advantages can be derived from the drawings and the following description.

SHORT DESCRIPTION OF THE DRAWINGS

Figure 2:
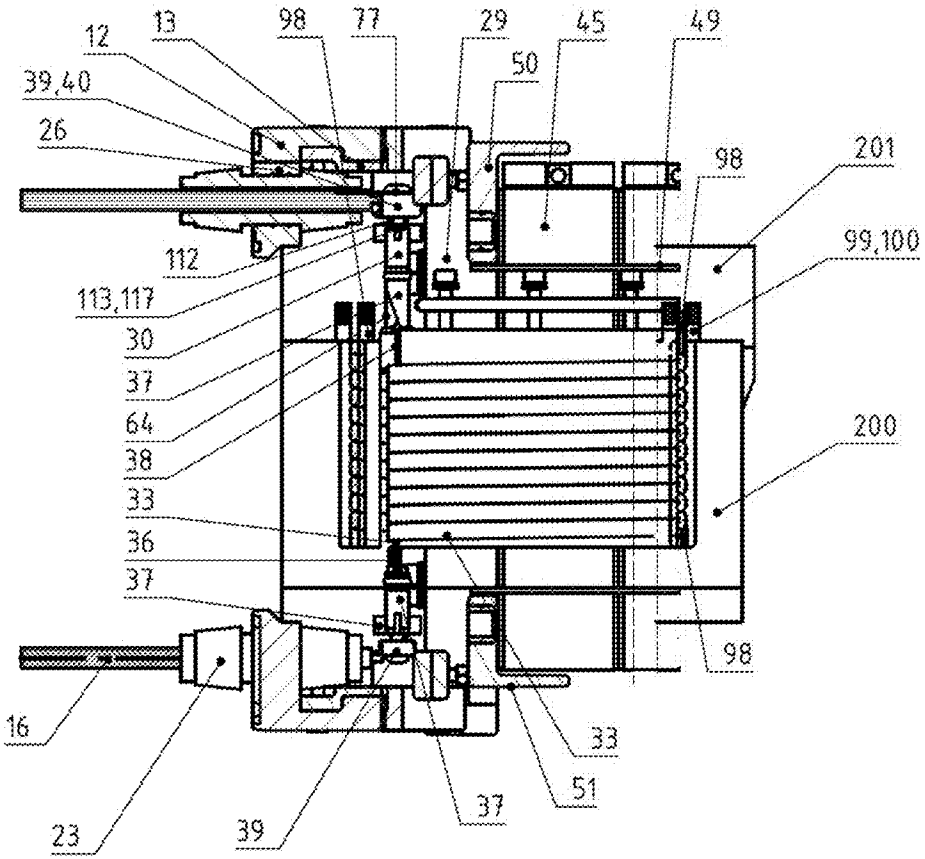
Figures 3A, 3B, 3C, 3D, 3E:
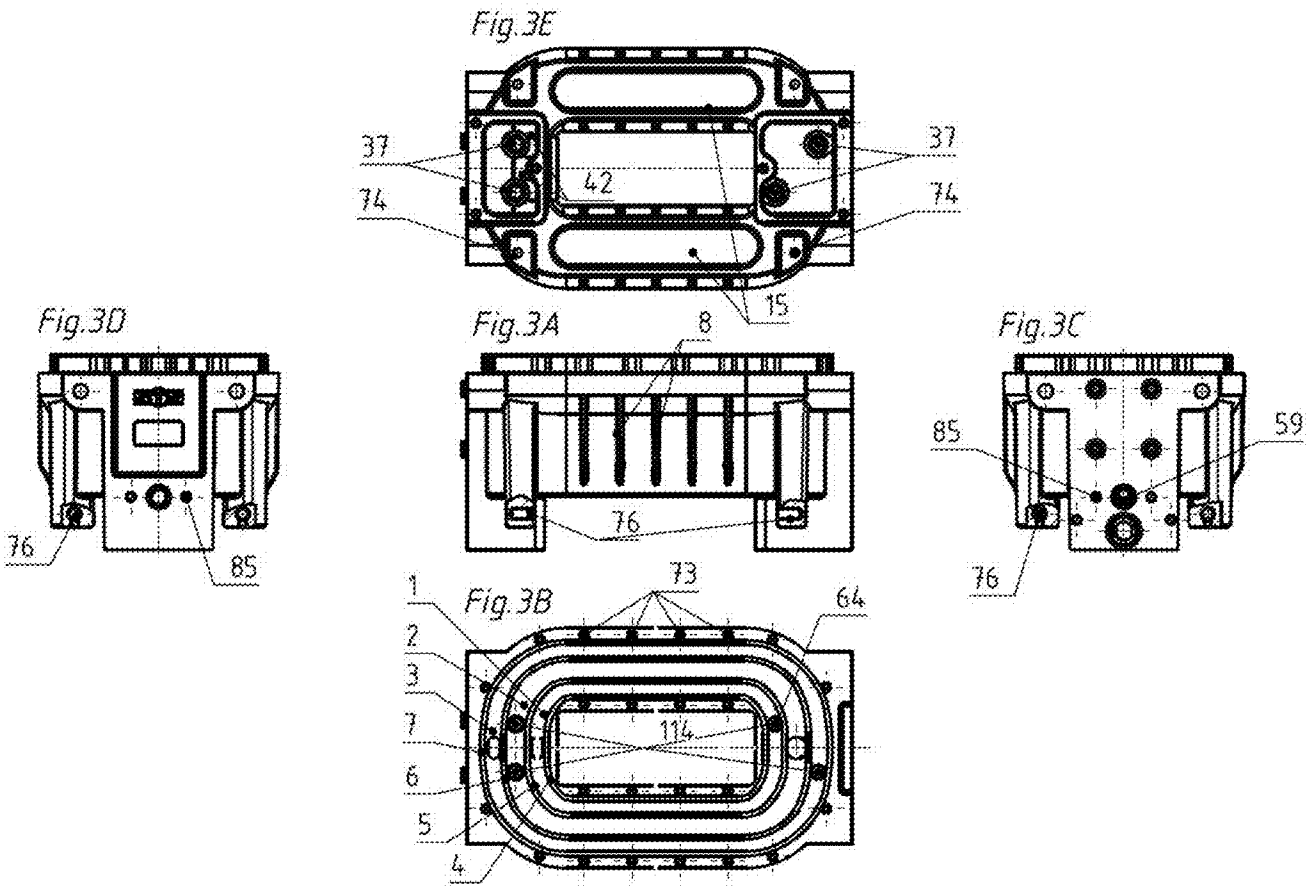
Figures 4A, 4B, 4C, 4D, 4E, 4F:
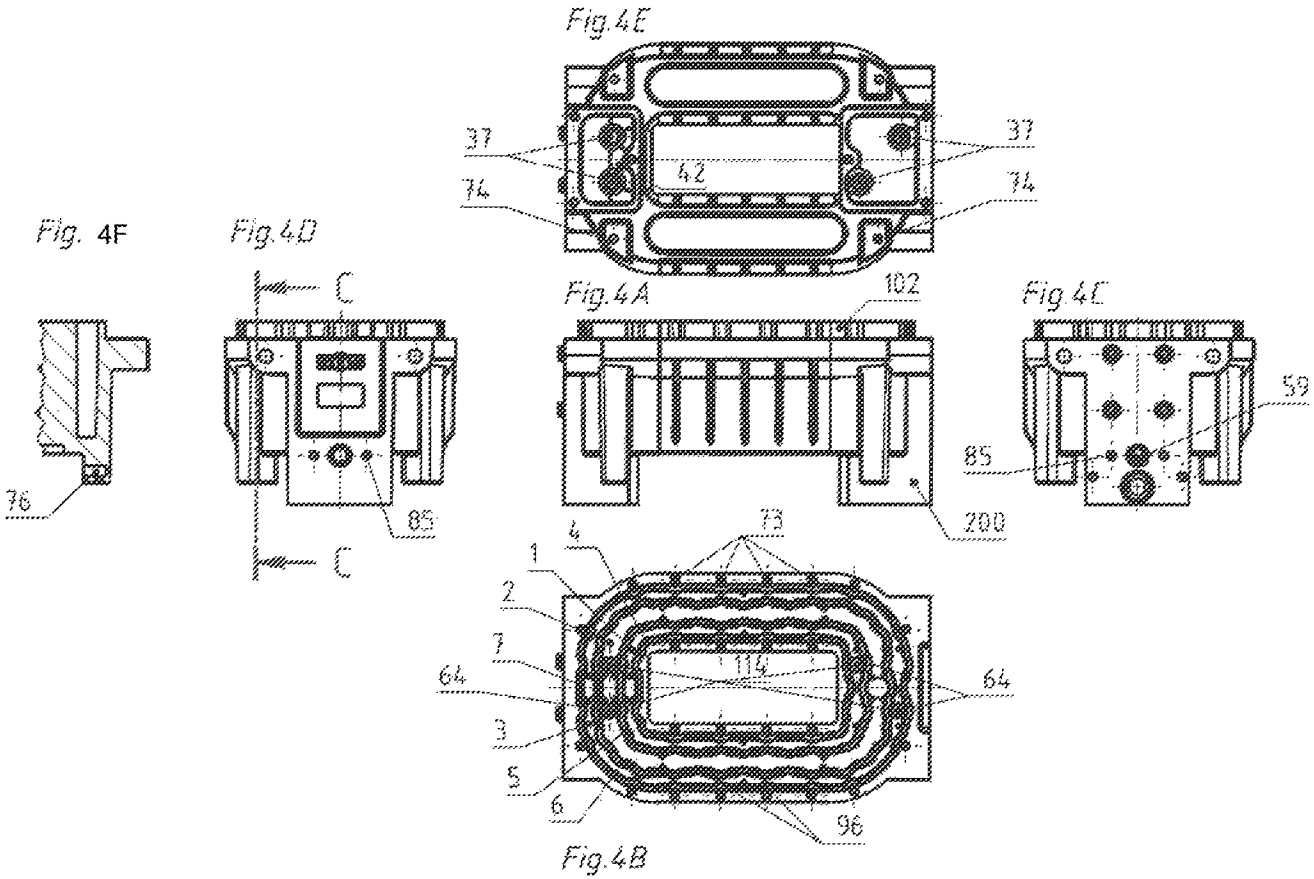
Figure 5:
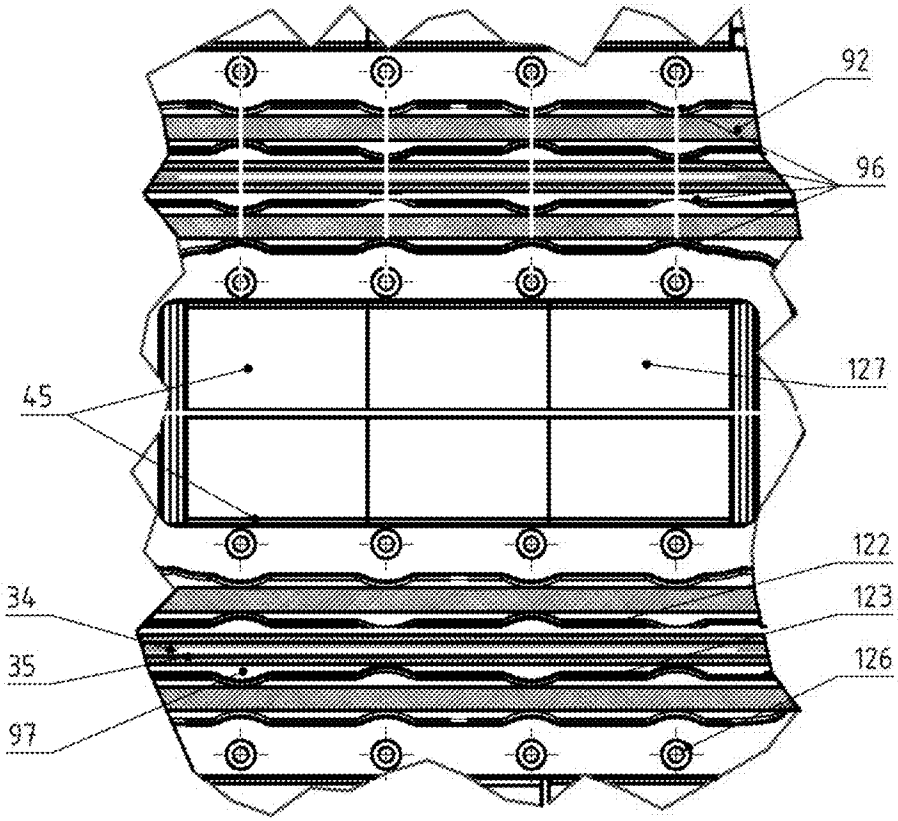
Figure 6C:
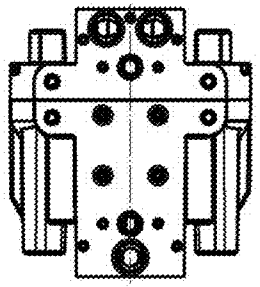
Figure 6A:
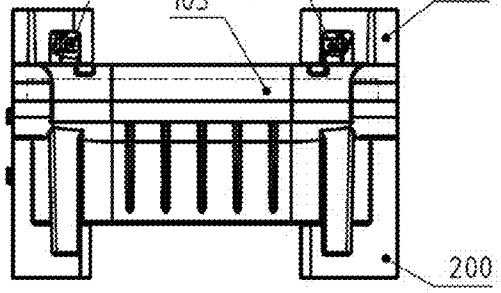
Figure 6B:
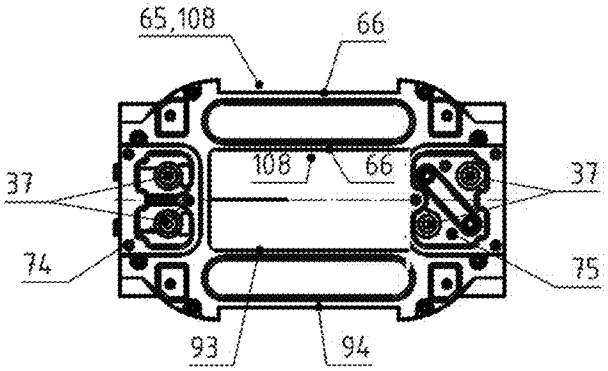
Figure 6D:
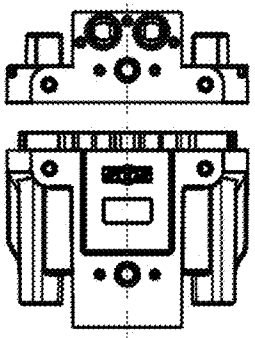
Figure 7:
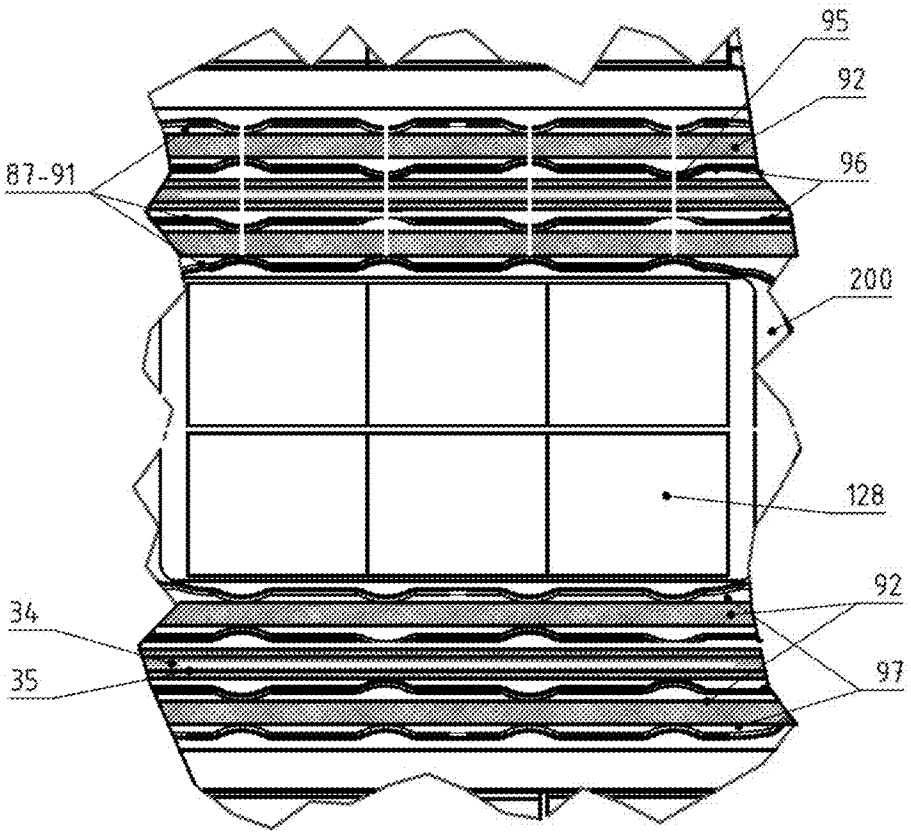

They show:

FIG. 1 the transformer and a cut through the windings, junction boxes and core FIG. 2 the transformer and a cut rotated 90° through the windings, and rotated about an angle through the winding bushings FIGS. 3A-3E the transformer housing and the winding chambers in the shape of an oval and with the same circumferential cross-sections, in various views FIGS. 4A-4F the transformer with winding chambers, in various views, and the waveform of the separating and outer walls FIG. 5, 5A the transformer and the bracket for the windings, with waveform separating walls FIGS. 6A-6D trapezoidal transformer, as transformer and lid housing, in various views FIG. 7 transformer housing, for an enlarged window and core cross-section, from FIG. 6

Figures 8A, 8B, 8C, 8D, 8E:
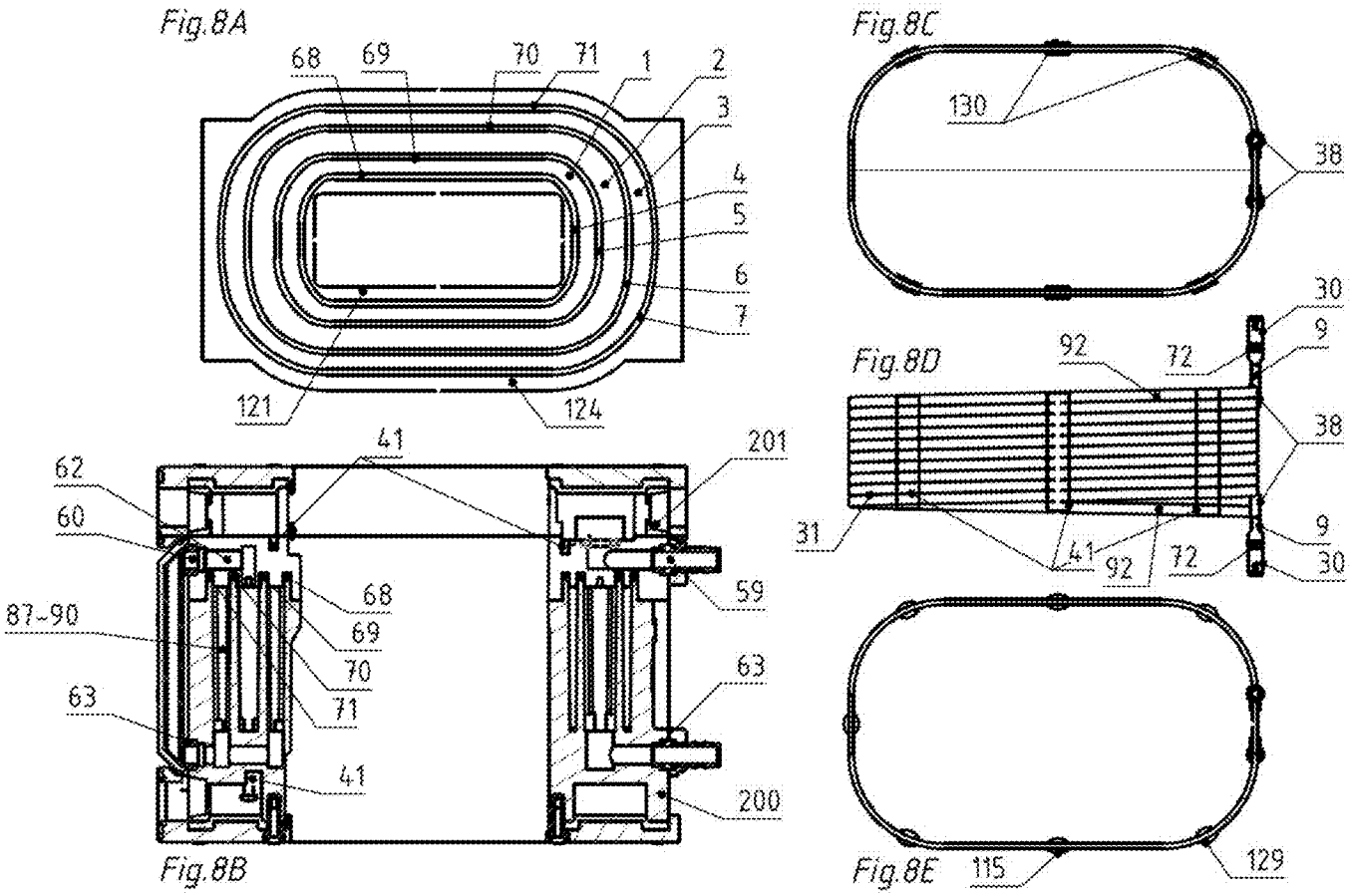
Figure 9A:
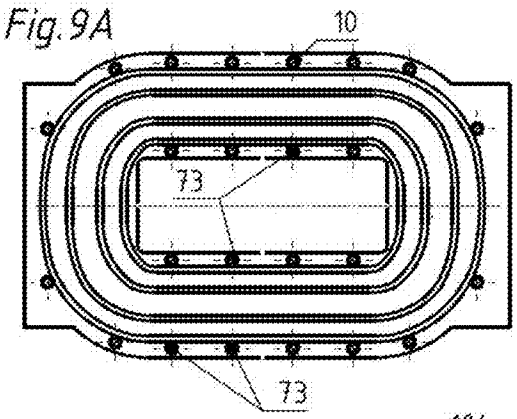
Figure 9B:
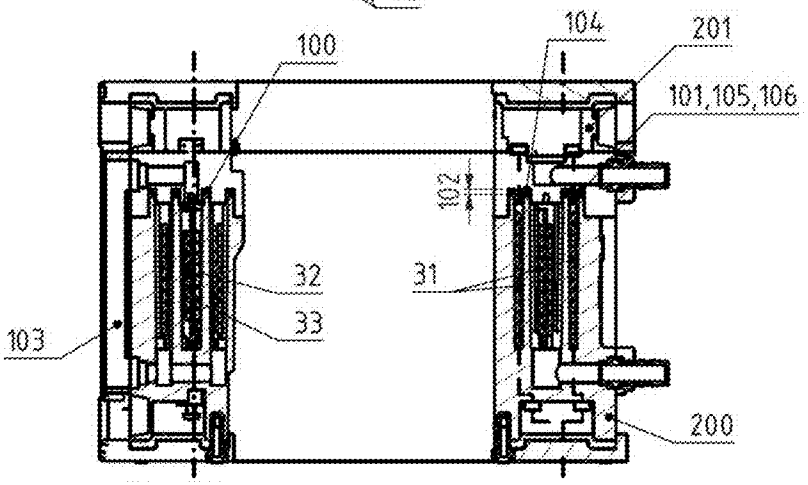
Figure 12C:
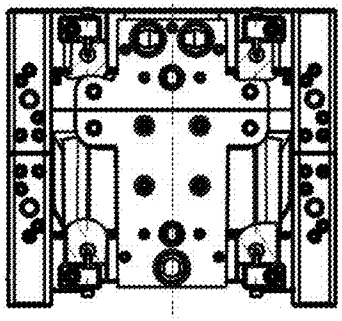
Figure 12A:
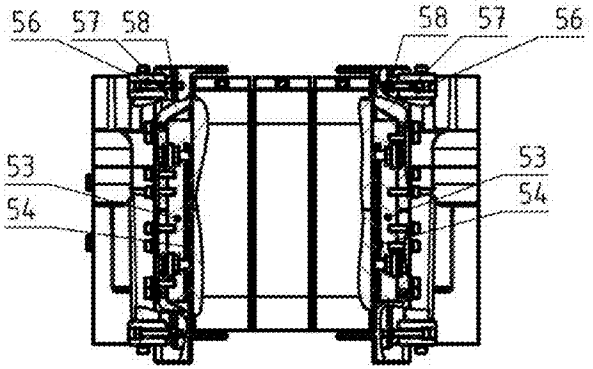
Figure 12B:
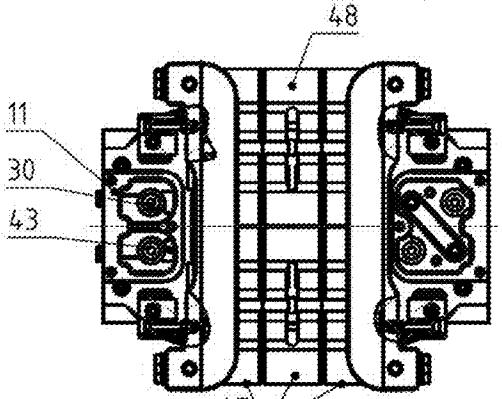
Figure 13:
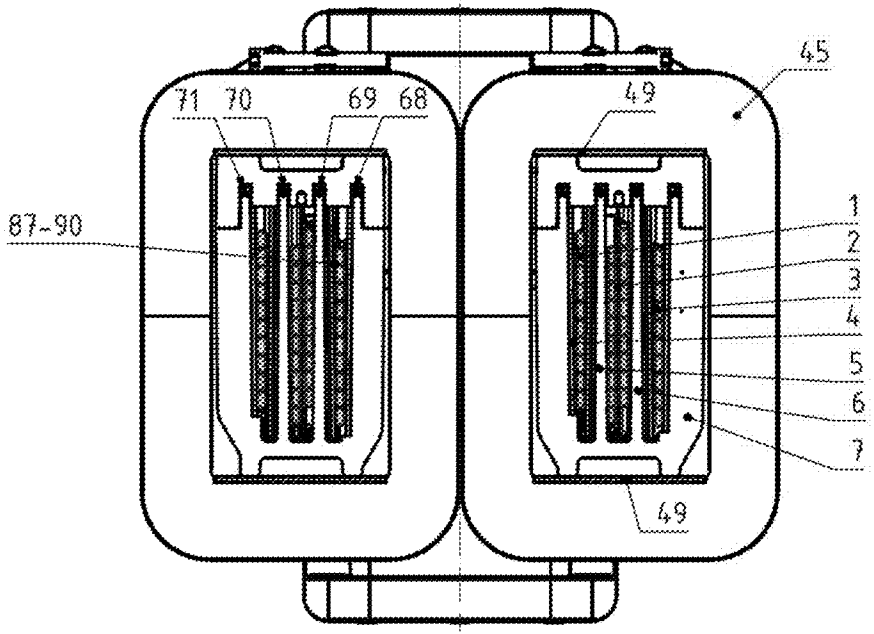
Figure 14C:
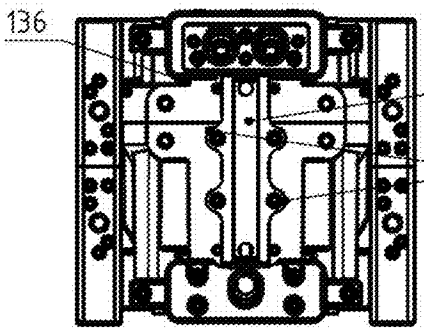
Figure 14B:
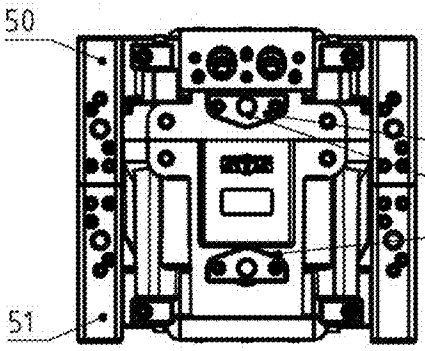
Figure 14A:
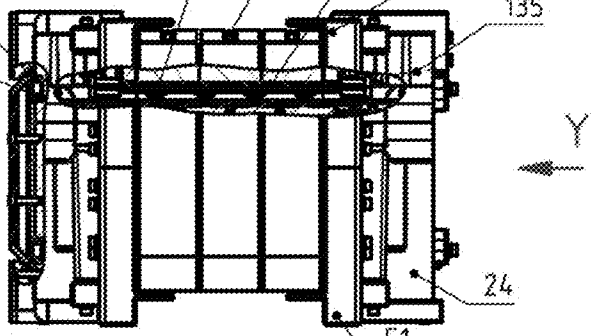
Figure 14D:
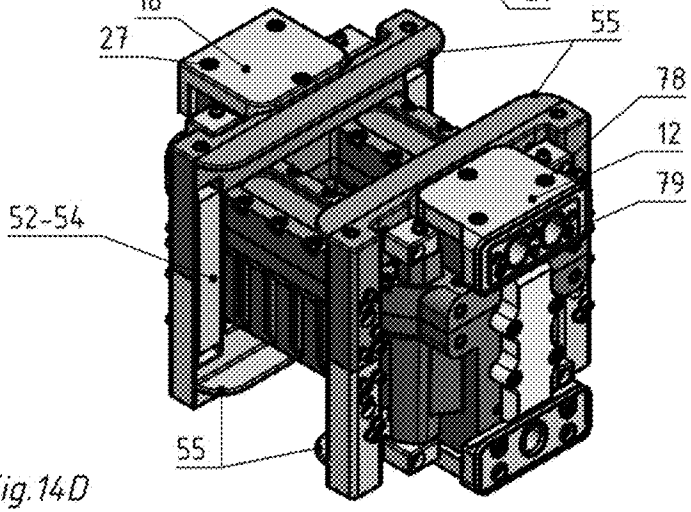
Figure 15B:
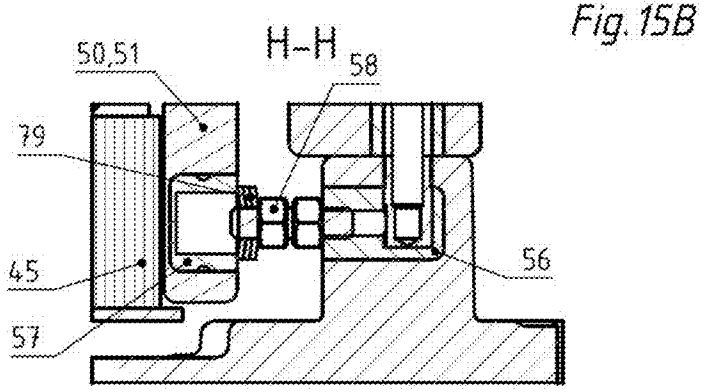
Figure 15C:
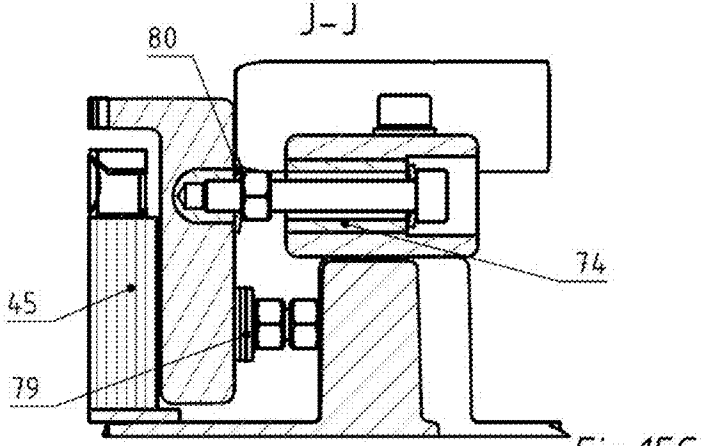
Figure 15A:
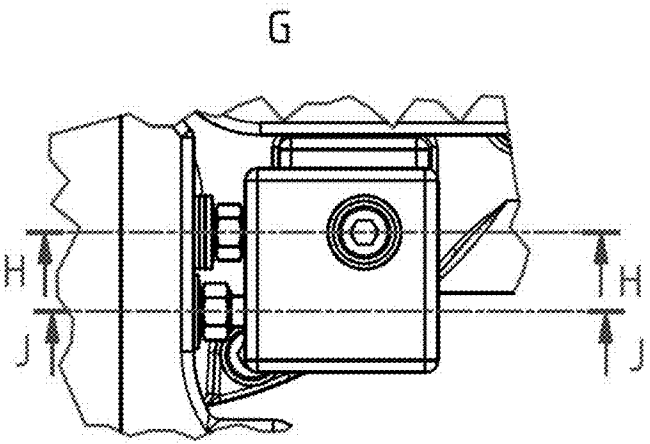
Figure 16:
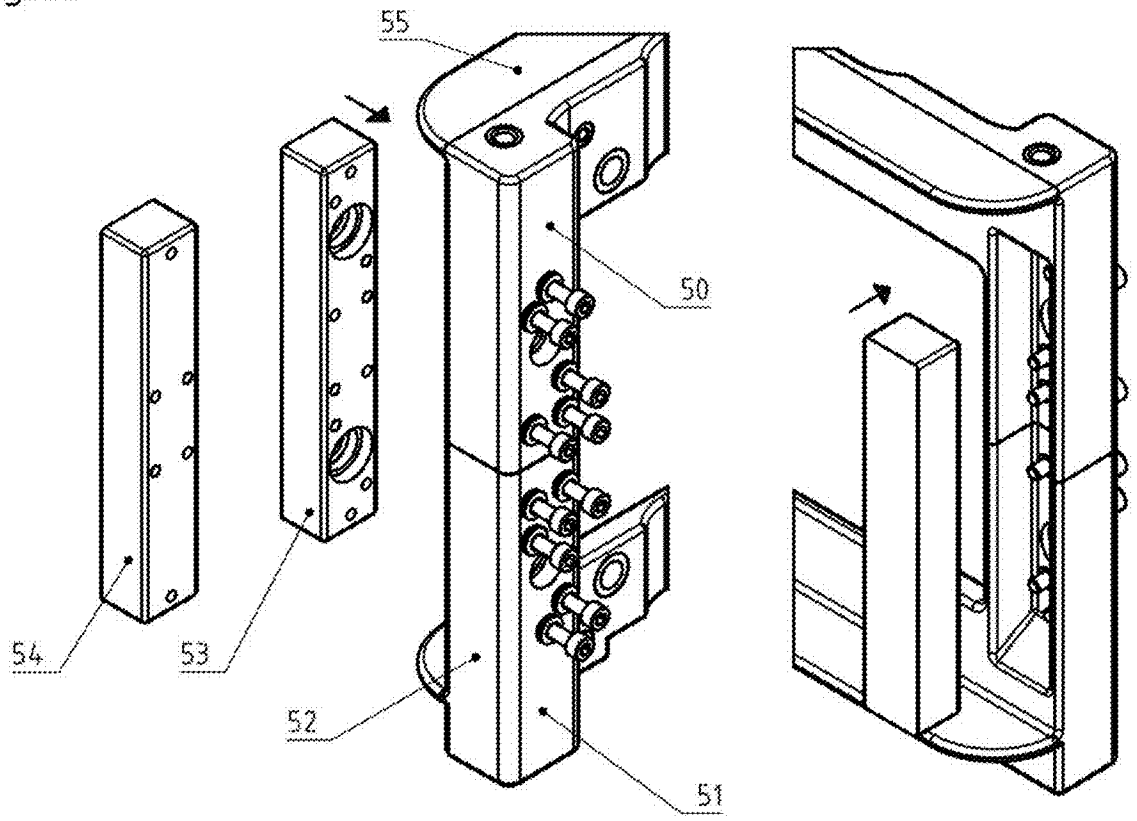

FIGS. 8A-8E MF transformer, winding chambers, windings external and hydraulic circuitry in housing FIGS. 9A, 9B the transformer, the winding chambers with windings and their electric circuitry FIGS. 10A-10D numerous MF transformers as assembled as a cascade column FIGS. 10E-10I numerous MF transformers, integrated in housings, in a multiple MF transformer multifunction housing FIGS. 11A-11D placement of the housing lid on the transformer housing for forming an overall transformer housing with closed chambers FIGS. 12A-12C MF single transformer, complete with stretcher frames, without junction box sealing lids FIG. 13 cut through the straight sides of the MF transformer with spacing and ventilation configuration design between the housing and the cores FIG. 14A-14D single MF transformer, complete with insulating-sealing lids on the HV and LV junction boxes FIGS. 15A-15C tensioning mechanics of the cores FIG. 16 stretcher frames with nut and bolt connections or cooling bodies

DESCRIPTION OF PREFERRED EMBODIMENT EXAMPLES OF THE INVENTION

The FIGS. 1-16 show the fundamental structure of an MF transformer with, for example, solid matter ester or pure water insulation, particularly the separation chamber technology for the primary and secondary windings 31, 32, the primary and secondary connections, the hydraulic connections 59, 60, the cores 45, the core retaining and connecting frames 50, 51, and the mechanical attachments in the housing or cascades. The transformer and cover housing 200, 201 are implemented in a closed chamber technology, and further functional units such as hydraulic bridges and flow channels are incorporated as voltage barriers between the primary and secondary windings 31, 32. Charge carrier scaled HV-LV junction boxes and sealing lids, 18, 25, with HV/LV insulating seals 19, 28 enable the first beam spot-base point-free MF transformers for various AC medium voltages and frequencies in DC/AC current converters.

The MF transformer can be installed and implemented in high-voltage (HV) or low-voltage (LV) converter housings or transformer housings, which enables a floor, partition panel, or stacked assembly, but also an assembly on the partition panels with a floor, lid, or cascade assemblies in LV ranges.

Figures 10A, 10B, 10C, 10D:
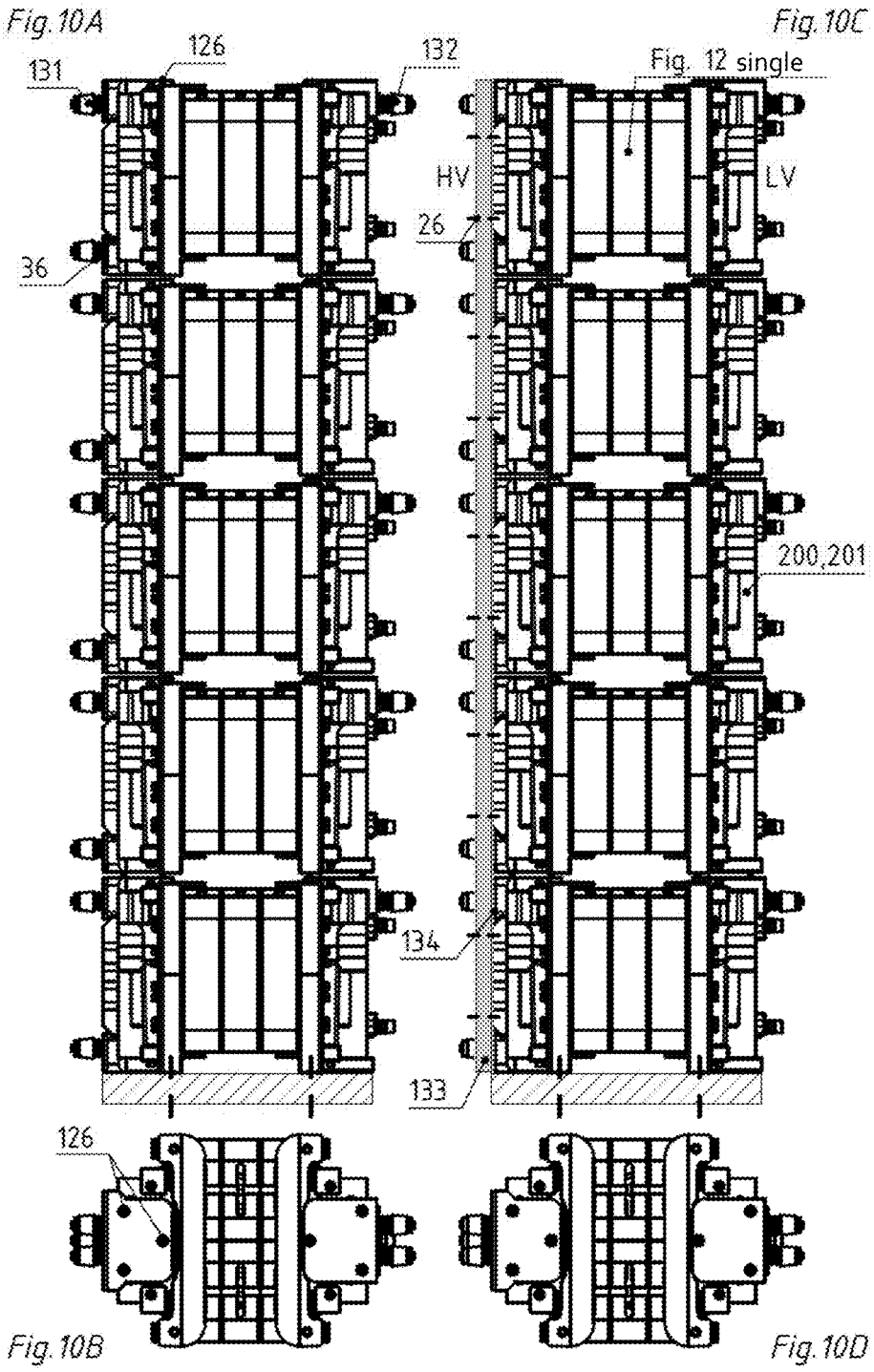
Figure 10E:
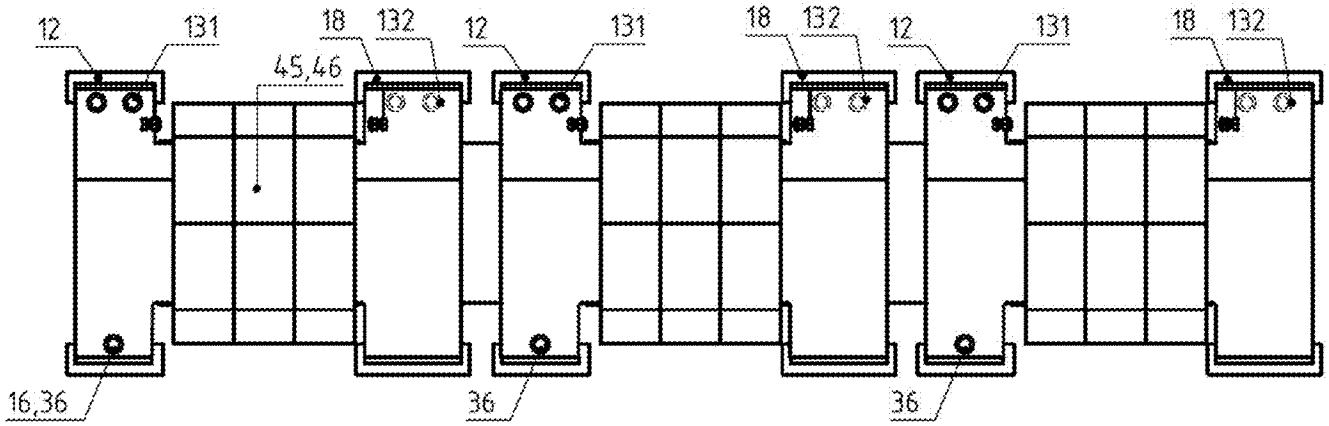
Figure 10F:
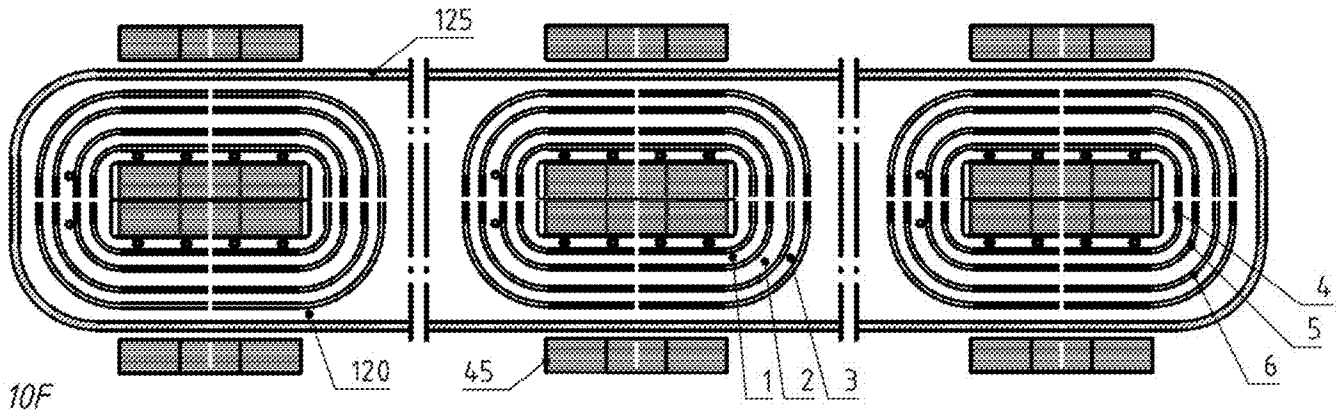
Figure 11C:
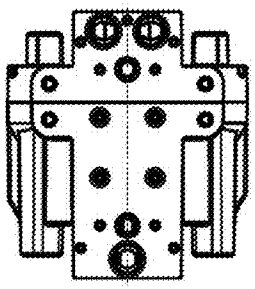
Figure 11A:
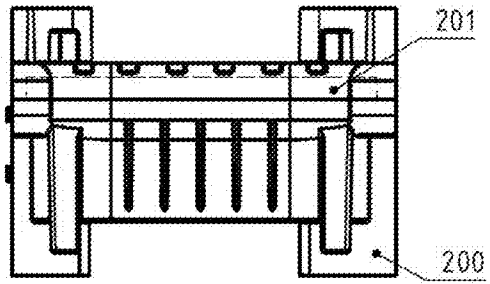
Figure 11B:
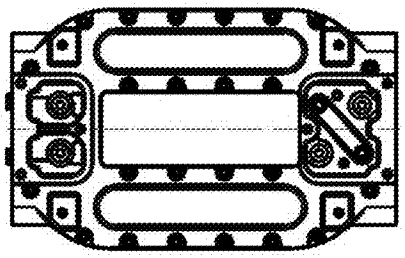
Figure 11D:
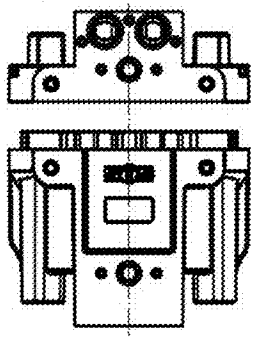

Connecting technologies and designs of the transformer and cover housings are shown, including multiple MF transformers in a cascade array according to FIGS. 10A-10D, or in the form of a multi-functional housing according to FIGS. 10E, 10F.

With the continuously high innovation density of the invention, it is also of concern that, aside from the well above average insulation reliability and cooling, the losses in the windings 31, 32 and cores be significantly less than with prior typical MF transformers and considerably less than with conventional transformers for frequencies of 16⅔ or 50 Hz.

This is attained in that, among other things, the windings 31, 32, 33 are not made of hollow or solid conductors, as was the case previously, but rather, in their place, MF or HF strand windings 92 are used as anti-skin and proximity conductors, the individual wires of which are coated, for example, with an insulating varnish.

In order that the core losses are also kept low, nanocrystalline core material 45 is used, although this is not obligatory. The heat losses from nanocrystalline materials are conducted in part through the housing and elastic plate substrata 49 in the interior of the transformer, and can be discharged there. Light air currents, necessary for other cooling systems, discharge the excess heat.

When, for reasons that shall not be listed, other core materials are used for the cores 45, with higher losses, e.g. amorphous materials, a surface-core cooling system 53, FIG. 16 in the region of the core separation, cuts 50, 51, can optionally also be incorporated. For this purpose, it is only necessary to exchange the connecting rods 54 in the insulating core frames 50, 51 with flat rods configured in the same manner, designed as coolers 53.

For further possible innovation impetuses in future converter transformations, still more sealed MF transformers can be implemented in multiple-implementations according to FIGS. 10A-10I, which represent further weight and volume reductions, as well as simplifications to the assemblies and components.

FIG. 1 shows the transformer according to the invention in a sectional view. Preferably, the housing of the transformer is designed as two parts, and consists of a transformer housing 200 and a cover housing 201, which can be permanently connected thereto. The housing can, however, also be a one-piece housing, if the transformer housing and cover housing are glued together in a sealed manner after the winding has been assembled therein. The transformer housing 200 comprises numerous winding chambers 1-3. These winding chambers 1-3 are separated from one another by insulating housing walls 4, 7 and insulating separating walls 5, 6. When the transformer housing is sealed with the cover housing 201, sealed winding chamber 1-3 are obtained by means of insulating seals, wherein either a primary winding 32 or a secondary winding 31, as well as, optionally, secondary windings 33, are accommodated in each winding chamber 1-3. The windings are connected via electrical bushings 30 in the transformer housing 200 and the cover housing 201 to electrical connections 36 by means of junction boxes 11, 17, which are integrated in the transformer housing 200 and/or cover housing 201. The junction boxes 11, 17 are closed in a sealed manner by means of lids 12, 18 and insulating seals 13, 19, i.e. in terms of "voltage technology." One or more cores 45 are disposed on the straight sides of the windings and their housings. The individual winding chambers 1-3 are completely filled with an insulating liquid 87-91, e.g. an ester or an insulating gas. According to the invention, the strand windings 92 are placed in the winding chambers 1-3, and the winding chambers are filled with an ester, transformer oil, doped pure water cooling agent, or a suitable gas.

With the transformer according to the invention, the winding chambers 1-3, separated from one another, are produced without windings, in vacuum or pressurized gel casting compound procedures, for example. The transformer and cover housings 200, 201 are first produced without windings, and can be manufactured without defects, and without pores or gap pockets, particularly in the region of the separating walls 5, 6. Even if casting defects occur, these defects can be detected by means of special PD measurements or X-ray procedures, and the defective housing parts can be discarded.

The transformer housing 200 and the cover housing 201 are either connected to one another in a material-locking manner, for example by means of an adhesive bonding or casting, or they are connected to one another by mechanical means in a force-locking and/or form-locking manner, or connected to one another by means of tensioning devices 25, 27, 46, placed on the exterior of the housing. In particular, attachment means 74, preferably with spring components 45, are provided on the junction boxes for connecting the transformer housing 200 to the cover housing 201 and the lids, which connect the cover housing and the lids to the transformer housing in a self-tightening manner.

On the other hand, with conventional casting compound-solid matter insulation technologies, defects in the intermediate insulation and bordering components of the transformer windings, "oval-radial" disposed windings, are nearly impossible to locate with the current measurement and diagnostic procedures. Otherwise, defects are only identified by means of chance, i.e. with object destroying measures. It is visible that such tests can be used at any rate as system checks, but not as inspections for individual parts.

Another disadvantage of the production of windings in solid tube-hollow conductor technology is that, in conjunction with most height specific current strengths, or MF frequencies, unequally higher skin and proximity losses occur than with the HF or MF strands 92 used according to the invention having equal cross-sections or larger cross-sections.

Liquid insulation 87-91, combined with pore-free, thin solid matter separating walls 5 and 6, or numerous separating walls and outer walls 4, 7, are advantageous because, on one hand, a maximum reliability of solid matter insulation is obtained, and on the other hand, the heat losses of the windings 32, 31 can be readily discharged by means of the circulating liquid insulation or the circulating gas. The insulating and cooling medium, e.g. oil, ester, pure water or gas, e.g. pressurized air or $SF_6$, or a cooling agent gas, does not need to be pumped through a narrow cross-section and extensive length of a tube, but instead represents an insulation in the form of an "outer surface cooling agent" that is continuously being exchanged. Even if air bubbles are present in the liquid insulation, for example, due to work performed independently of the manufacturing, i.e. coming from outside of the production process, and voltage is applied, defects do not occur, because the windings 31, 32 are located in sealed winding chambers 1-3, FIG. 1, having insulating separating walls 5, 6. As a result, quickly changing air bubble constellations are generated by the circulation of the insulating liquid in the transformer, which do not enable a disruptive discharge or surge, because the temporary PD intensities change continuously and extremely quickly, or disappear as a result of the permanent air separation, more quickly than it would be possible for damage to occur due to lack of insulation.

The differences to solid matter insulation transformers, as well as to conventional oil or ester transformers, are the primary and secondary windings 32, 31 encapsulated in plastic, having ester, pure water or gas 106, 107, insulation sections between the primary and secondary windings 32, 31. The individual winding chambers 1-3 comprise connecting channels, which are disposed separately on the housing 200, FIG. 1, or integrated in the housing 200, FIGS. 8A-8E.

Neither air bubbles, nor esters or oils 87, moderately enriched with moisture, nor short or long strands of lint or limited impurities in the liquid insulation, can cause electrical disruptive discharges between the windings 32, 31, or 33. This is because chamber walls 4-7 and hydraulic bridges dimensioned for medium voltage as crossover connections, FIG. 1, 60 or FIGS. 8A-8E, do not physically allow for disruptive discharges or surges.

An evacuation procedure during the initial assembly of the transformer ensures that hollow spaces beneath the inner surfaces of the strands 92, encased in silk for example, and their micro-hollow spaces, are filled with insulating liquid. This thorough wetting of the casing and wire intermediate spaces of the strands 92 in 1-3 with the insulating liquid 87-91 is a substantial factor in obtaining limited PD intensities, even with high voltages. The second substantial factor is that the strand wires 92 are continuously connected in a thermo-conductive manner via the liquid insulation, which decisively promotes the heat dissipation from the strand profiles outward in the insulating liquid flow.

Thermo-technological differences to conventional transformers filled with oil or ester, in particular, occur here. Because no "slow internal" convection currents determine the cooling effect in the metal housing of the transformer, but instead, actively pumped circulating currents flow past the windings 31, 32 and the bushings 9, 30, as well as the connections 76, flowing indirectly past the annular contacts 39 and directly past the contact force-screwed transition resistors 112 and 39, the resulting heat losses are discharged to a much higher degree than is possible with any other cooling method in conventional, filled with a lot of oil, but also multiply submerged, MF transformers in smaller containers. Due to the excellent cooling system, the load currents of the primary and secondary windings assume significantly higher values than is given by the power rating, which is decisively advantageous, for example, for start-up and braking procedures, as well as on long inclines.

With the MF transformer according to the invention, FIGS. 1-16, the insulating liquid 87-91 or 106 and 107 filled into the winding chambers is displaced in a forced current. Due to relatively small filling amounts, this results in short circulation periods and an effective and reliable cooling of the outer surfaces of the windings 32, 31, the bushings 9, 30, 111, the connections 76, and the contacts 112, 39. This means that the discharged heat losses of the transformer are transported directly to the heat exchanger and can be fed into the atmosphere by means of radiators. Heat exchangers and radiators are external and are not the subject matter of the invention. The cooling of the MF transformer by means of a liquid medium is usually only implemented as a secondary aspect of the cooling of the power-electronics of the traction.

This effective forced cooling system, by means of an insulating liquid, e.g. 87-91 or 106, 107, has the advantage over rigid-hollow winding conductors with pure water cooling, in that the MF transformer cooling system can be used, without deionization devices for converter semiconductors or other components, with significantly different voltages, which results in a significant simplification of the overall system of a transformation converter.

Figure 5A:
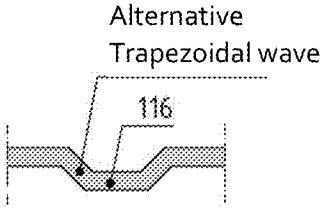

Another advantage of the closed winding chambers 1-3 is the design of the housing and separating walls 4-7, FIGS. 5 and 7. The housing and separating walls exhibit integrated projections or separate spacing components, by means of which the windings 31 are radially positioned and fastened in place in the winding chambers. The housing and separating walls can, for example, be waveform 95, 96 or trapezoidal 116, and spatially separate the primary and secondary windings 32 and 31 from one another. Not only for the normal operation, but also during strongly vibrating and impact stresses, or short circuits, these waveform and trapezoidal separating walls 95, 96, 116, FIG. 5 and FIG. 5A, between the winding chambers 1-3, are a central element of the transformer. The "waveforms" or "trapezoids" of the separating walls 95, 96, 116, are shaped such that the electrical field strengths are maintained at nearly uniform levels in the liquid and solid matter insulations, aside from directly on the strand surfaces.

Between the primary winding 32, the secondary winding 31 and toward the grounds 45, 46, there are two insulation barriers, in accordance with the invention, which "accumulate" and are made of solid matter insulation in the form of the housing and separating walls 4-7 and the liquid insulation 87-91, as well as partial external air pathways 16-29 (FIG. 13). The liquid insulation is maintained in a continuous flow during operation, and forms a continuously "regenerating liquid insulation" on the locations inside and outside of the MF transformer to which insulation is relevant.

The combined small and large arcing distances or creep distances, 16-29, and 42-55, respectively, in and on the junction boxes 11, 17 and bushings 9, 30 also belong to the arcing distance, creep path concept, interrupted by insulation locations.

This concept for the insulation, according to the invention, has decisive advantages: electrical disruptive discharges or surges between the primary 32, and secondary windings 31 cannot take place in actuality. This also applies, as already explained, in the otherwise feared presence of lint or filaments in the insulating liquid, or along the outer configurations of the transformer, when no insulating and sealing barriers are present.

Due to the encompassing of the windings with solid matter and liquid insulation on all sides in the winding chambers 1-3 for the primary and secondary windings, using separating walls 5, 6, it is nearly impossible for a short circuit, or a disruptive discharge or surge initiated thereby, to occur between the primary and secondary windings 31, 32, 60, or against the ground (cores 45, 46).

Because the separating walls 5, 6 could accommodate the temporally shortened voltage difference between the primary and secondary windings 32, 31 on their own, this do not occur due to the monitored liquid flows.

The spacings of the respective windings 32, 31 to the separating and outer walls 5, 6, 4, 7, between which are filled with liquid insulation 87-91 or gas insulation, are, on average, as large as the thicknesses of the insulating separating walls. This results in a high degree of combined reliability and compliance to, or remaining well within, the specified PD threshold values.

The reliabilities accumulate in multiple respects, firstly due to the reliably obtained lack of pores or micro-pores, as can be determined by means of testing, in the separating walls and outer walls of the winding chambers, as well as the continuous exchange of liquid or gas insulation in all parts of the transformer, i.e. axially and radially in the winding chambers 1-3 and the bushing regions 9, 30, etc. Differing from solid matter insulation, the formation of conductive channels is nearly impossible throughout the insulation.

As shown in FIGS. 5 and 7, the separating walls 5, 6 exhibit offset wave contours 95, 96, disposed so as to be mirror images of one another, which always maintain and retain the windings in a "centered" position between the separating walls 95, 96. This means that at wave peaks on opposing surfaces of the windings, in addition to a solid matter insulation, there is always a doubled liquid or gas insulation, 87-91, or 106, 107, respectively.

In order to prevent the loss of this reliability aspect with a two-part housing at the interface between the transformer housing and the cover housing, there are axial stops or spacers 98, 99, FIG. 2, located on both sides of the front ends of the windings, which are each disposed axially "beneath" or "above" the windings, in order to lower the electric field strengths between the primary and secondary windings and the axially sealed ends of the winding chambers 1-3 to the windings 32, 31, and in the housing joining regions, FIGS. 1, 2, and particularly against the cores and tensioning straps 45, 46, to uncritical levels. In addition, there are so-called recesses 42, 43 and FIG. 13, in the outer region of the housing, forming air passage spacings on all sides of the cores 45.

FIGS. 1 and 8A show that joints between the housing walls 4, 7 and separating walls 5, 6 of the transformer housing 200 and the cover housing 201 are provided with hydraulic-electric chamber seals 68-71, contained in grooves 99. In this manner, the axial spacings 97, 98 to the respective limits on the base of the groove 99 in the transformer/cover housing are reduced with dimensioned bushing/surface resistances in the region 97, 98, 99 of the field strengths, such that in the case of surge or test alternating voltages, sufficient reserves are available.

In addition, there are options ensuring voltage consistency in the joint regions of the two housing parts 200, 201. Prior to the complete assembly of the transformer, according to FIGS. 12A-14D, the grooves 99 of the cover housing can be filled with a quantity of highly electrically insulating adhesive resin, as long as the possibility of disassembly can be sacrificed, wherein the groove base is set vertically "downward" in the subsequent assembly and hardening. Thus, a sealed one-piece transformer housing, provided with inner chambers, is created from each transformer and cover housing. This "fusion" of the transformer and cover housings can be executed in a variety of ways.

On one hand, self-adhesive prepared grooves in the separating wall joints of the cover housing 201 can be filled with a quantity of adhesive resin prior to the insertion of the seals in the grooves 99, such that the transformer and cover housings 200, 201 are insulated with a solid matter, and joined mechanically to form a single housing component. For this, the primary and secondary windings 32, 31 are equipped with bushings and seals prior to the joining, and the groove adhesive fillings are dimensioned such that after placing the transformer housing in the cover housing, the adhesive resin 101 does not seep out of the grooves.

The groove surfaces and the uppermost separating wall parts are treated with adhesive in the region where the transformer and cover housings are glued together, FIGS. 8, 9, such that the transformer and cover housings are connected in a material-locking manner, wherein the inner separating walls 5, 6 are also united to the housing inner and outer walls 4 and 7 by means of an adhesive connection 104, to form a sealed housing unit.

The preceding steps can also be carried out with suitable adhesive resins, without seals between the transformer and cover housings 200, 201. A gluing of this type would likewise "fuse" the transformer and cover housings to form a housing 101 without seals 68-71. With this fusion, it would be possible to do without fastening means 73 between the transformer and cover housings. Other measures could also be implemented in the region of the joints, such as separating insulating strips or circumferential caps with bushing supports (not shown), which significantly increase the electrical insulation, even without joint adhesive.

As a rule, the gluing operations wave constructions described above can, however, also be omitted, because the sealing connections 68-71 are sufficient for conventional operational voltage levels.

In a continuation of the present design, the depicted connection of the transformer and cover housing 200, 201 with screw connections 25, 27 and additional pressure build up on the transformer and cover housing by means of tensioning straps 46 over the cores 45 and elastically compressible plate substrata 49, can be omitted.

On the other hand, the use of tensioning straps 46 over the cores 45 and the elastic plate substrata 49 on the flat sides of the transformer and cover housings 200, 201 can render the screw connections 25, 27 according to FIG. 1 superfluous. This has the advantage that the MF transformers proposed according to the invention, in accordance with FIGS. 6A-6D are up to 20% "narrower," because the space for the screw connections 108, FIG. 6B, is no longer needed. Furthermore, the flange-space volumes is reduced, FIG. 7, which creates the possibility of increasing the core cross-section 128, FIG. 7, and the voltage time area, or the performance, respectively, of the transformer.

Effective options of this type for converter transformations also enable, for example, the stacking of up to 8-10 MF transformers "on top of one another" or "adjacent to one another," as is depicted in FIGS. 10A-10I. A configuration of this type, with numerous transformers, results in volume/weight reductions of the transformation converter, FIGS. 10A-10I.

An even more drastic reduction in volume is depicted in the FIGS. 10E, 10F. Proceeding from the FIGS. 10A-10D, only the inner part of the previous transformer housing, FIGS. 1-9B, is used with this proposal. The secondary individual chambers 1-3 form collectives, i.e. multiple secondary, winding spaces in arbitrary multiple transformer collectives, e.g. 3, 5 or 10 transformers, with the reduction potential presented by the omission of numerous outer walls 7, to form a collective outer wall 129 of the multiple MF transformer, as well as inner circuitries subjected to liquid and gas insulation, at least on the LV side.

With the design according to FIGS. 10E, 10F as well, the cores for individual, or in multi-integrated, transformers are disposed in the atmosphere, and not in the oil or gas insulation. The transformer and cover housings can be produced, for example, in 3×, 5×, or 100× designs.

The designs according to FIGS. 10A-10F represent an additional seal and weight reduction for converter transformation, which represent a possible further development of individual MF transformers to form multiple MF configurations.

The interior design of the winding chambers 1-3 and further embodiments of the MF transformer according to the invention shall be described in the following.

In FIG. 2, in particular, the electrical connections and bushings for the windings, as well as the seals between the transformer housing 200 and the cover housing, are depicted.

As such, among other things, spacers 98 for the windings 31, 32 are placed in the floor of the winding chambers 1-3, preferably integrated by means of casting techniques, in relation to the floors of the chambers such that the windings lie on the spacers 98, stepped in terms of height, FIG. 2, in a manner analogous to the gradients of the winding spirals, without impeding the flow of the insulating liquid 87-91.

The support brackets for the windings 31, 32 form the housing lid, FIG. 1, with elastic spacing bars 110 or spacer rings 109, with which the windings 31, 32, 33 are fixed in place by means of spring forces, meaning that they are held in place such that they are resistant to vibrations. The primary and secondary windings 32, 31 are retained with a series of spacers 109 and spacing bars 110 at dimensional spacings to the cover housing 201, FIGS. 1, 2.

This axial fixing in place of the windings in the housing parts 200, 201 is necessary in order that, with vibrational or impact loads during the travel of the train, or short circuit loads caused by magnetic forces, the axial motions of the windings 32, 31, 33 in the winding chambers 1-3, FIGS. 1-5, are suppressed.

The starts and ends of the windings 31, 32 and their attachment to the bushings 9, 30 represent fixed attachments of the windings, but beyond certain spacings of the windings 31, 32, are not sufficient on their own to retain the windings in the winding chambers 1-3, in order to prevent damage due to movement.

In the radial direction, the windings are retained by the corresponding separating walls designed with waveform or trapezoidal projections. Alternatively to FIGS. 4A-5A, 7, there is, however, also the possibility, according to FIGS. 8A-8E, of disposing the projections or spacing elements directly on the windings of the primary 32 and secondary 31 windings. In this case, the housing walls and separating walls 4-7 are not waveform or trapezoidal, but flat, FIGS. 8A-E, and form oval-shapes about the cores 45. In order that, accordingly, a centering and fixing of the windings 31, 32 and a uniform "insulation thickness" of the insulating liquid is obtained in the winding chambers 1-3 on all sides of the windings, FIG. 8B, waveform or trapezoidal winding clips 129, FIG. 8F, and 130, FIG. 8C can be attached to the windings 32 or 31, their configuration being designed such that the liquid insulation 87-91 or gases 106, 107 can continue to fill and be exchanged between the windings 32, 31, as well as the inner surfaces of the housing and separating walls 4-7.

The depicted advantageous attributes of the offset configured wave or trapezoid shaped housing and separating walls 95, 96 can also be implemented here, if wave bridging elements 115, FIG. 8F are attached in an offset manner about the secondary and primary windings 31, 32, 33, FIGS. 8A-8E, which rest against chamber walls 1-7, FIGS. 8A-8E, depicted in the upper left region, not equipped with waves. This measure is an option for simpler transformer and cover housings according to FIGS. 8A-8E and FIGS. 10A-10I.

In the axial regions of the winding chambers 1-3 and the winding 32, 31, 33, the thickness of the liquid insulation in the region of the bushings 9, 30 reaches nearly twice that as in the radial regions of the windings/winding chambers. This is so that, in the region of field deforming configurations, e.g. the bushings, larger portions of the operating and test voltages, and their electric fields are displaced and decreased in the liquid insulation, or the greater radii of the bushings 9, 30 in the region of the cone holes 64 and the radial spacings of the winding, separating or outer walls, receive significantly lower PD field strengths.

This measure for the partial chamber widening, FIGS. 4A-4F, in the region of the winding heads is necessary in order that the input/output bushings for the primary and secondary windings is increasingly surrounded by liquid or gas insulation.

This is also to ensure that the flows can arrive via sufficient diameter/cross-sections, FIGS. 4A-4F, of the bushings 9, 30, or the cone holes 64, in and outside of the windings in the winding chambers, and partial temperature increases with respect to the bushings do not occur in parts of the MF transformer.

In these enlarged chamber regions 1, 2, FIGS. 4A-4F, the bushings 9, 30 are rotatably locked in place by means of solder pockets. The seals and the bushings 9, 30 are pressed into the cone holes and stretched in a radially deforming manner when inserted 64.

All shapes, including options for the closed winding chambers 1-3 for the primary 32 and secondary 31 windings are designed such that the hydraulic-electric seals 68-71 may optionally be subjected to the described adhesive supplementary measures, 99-102, between the transformer and cover housings, which lie outside of the highest electrical field strengths, which accumulate directly on the first and last windings of the primary/secondary windings 32, 31 and the solder pockets 8, 38, FIG. 2 of the bushings.

There are cast fitting-screw connections 73 provided with tensioning adjustments 115 to compensate for the placement procedures of the seals 68-71, which exert a surface pressure by means of the seals 68-71 on the housing and separating walls 4-7 between the transformer and cover housings 200, 201, FIGS. 1, 2. By this means, the leakage of ester or insulating media 87-91 or insulating gas 106, 107 under high pressure, from the scaled housings 200, 201, is factually impossible. At the same time, the housing and separating walls 4-7 form the solid matter insulation barriers of the winding chambers 1-3.

The same applies for the optional housing gluing 99-102. The flows of the insulating hydraulic fluid 88-91, alternatively, the gas flows 106, 107, can be rotated 180° by means of the pathways for the liquid or gas insulating media 59-60.

The insulating liquid 87-91 is supplied via an upper hydraulic connection 59 and conducted in parallel into the outer winding chambers 1 and 3. From there, the insulating liquid is conducted from the outer chambers 1, 3 to the inner chamber 2 via a hydraulic bridge 60, from where the liquid is discharged through the lower hydraulic connection 59 in the chamber. The flow direction of the insulating liquid can also be reversed 180°, of course. The supplying of the insulating liquid to the hydraulic connections 59 can occur via external insulated hose connections. The hydraulic bridges can also be integrated in the housing of the transformer, 103, FIGS. 9A, 9B.

A bubble-free liquid surrounding of the windings and all voltage conducting components with insulating liquid is thus ensured in the regions of the primary and secondary connections in that bushing fittings 9, 30 in the cone holes 64 for HV and LV connections in the transformer housing 200 and the cover housing 201, are subjected to pressure following the vacuum treatment.

The insulating liquid 87-91 in the winding chambers 1-3 is preferably subjected to hydraulic pressure.

Low transition resistances between the windings 32, 31 and the solder pockets 38 of the bushings 9, 30 for the contact sleeves 112, the annular contacts 39, and the connection cables (without a reference number), are obtained with contact screws 76 and the barrier contact springs 77 for the primary and secondary annular contacts 39 on the connections.

The MF transformer insulation concept, according to the invention: a continuous series circuitry: solid matter separating walls 5, 6 and regenerating liquid insulation 68-71 or insulating gas 106, 107, is implemented without gaps in that all windings 32, 31, 33 are implemented with continuous chamber-shaped hollow space solid matter insulation and liquid insulation fillings 68-71, which guarantee the electrical and mechanical reliability of the MF transformer. This also applies for the optional converter (GU) winding 33, which is disposed between the first and second layer 1, 2, FIGS. 8A-8E, of the primary winding, and by means of intermediate insulation 34, is protected from surge voltage. In order to keep the leakage inductance of the converter winding to the primary and secondary windings equally low, the converter winding 33 is implemented as a surface winding 33-35. The converter winding 33 is preferably designed as a foil winding 35, and is inserted through an intermediate insulation 34, enclosing it on both sides. Reference number 35 indicates that the converter winding is located between the $1^{st}$ and $2^{nd}$ layers of the primary winding 32. In a lateral manner, the foil surface winding encases a strand 34, FIGS. 2, 8A-8E, such that a leakage inductance reducing covering is provided between the $1^{st}$ and $2^{nd}$ layers of the primary and secondary windings.

Primary and secondary connections 30, field strength and PD minimizing annular contacts 39 are accommodated in the junction boxes 11, 12, 17, 18, among others, for the cable connections, which encompass charge carriers, outside of the transformer/cover housing. This means that creep paths and arcing distances for potentials in the vicinity of the transformer, as well as the cores 45 and the tensioning straps, FIGS. 1, 2, are not, however, significantly minimized in their effect (approval test).

Due to significant spatial and volumetric reductions in the region of the connections, and hermetic encapsulation measures for the connections in the form of cast junction boxes, insulation seals 13, lids 119 and insulating grommets 23, FIGS. 1, 2, with vertical pressure 25 and horizontal pressure 26, the spatial distances could also be analogously reduced in medium voltage systems to a fraction of the otherwise normal spacings and potential distances.

This is because, among other things, the soft seal-compression components for the lid 12 or grommets, e.g. 14, among others, are created in conical compression holes in the junction boxes 11 by means of MS insulation encapsulations that can be added or removed, in the form of junction boxes 11, 12, 17, 18, and lids 12 that are sealed on all sides so as to be sealed against charge carriers.

In order to generate additional voltage and spacing reserves in the region of the junction boxes, connections 30, and with respect to >25 kV transformers, there is the optional possibility of separating the cores 45 from one another with insulating caps and foils, such that the cores do not function as continuous conductors, but rather, form a core-number potential cascade between the HV 11 and LV 17 junction boxes 17. This also applies for the converter connection 118 and the LV connection boxes 24, 28, 119, 27.

Conversely, there is also the option of short circuiting 45, 46, and grounding the cores and tensioning straps, and thus placing a potential-separating grounding bridge between the HV and LV junction boxes. This means the high performance MF transformer can additionally be implemented for a potential separation between the HV and LV converter components.

Partial discharges initiating electrical field strengths are also prevented between the junction boxes and cores, among other things, in that, in the junction boxes, insulating material recesses 42, FIGS. 4A-4F are provided in the HV and LV junction boxes and beneath the elastic plates 49, FIGS. 4A-4F, 15A-15C, which provide the cores on the HV and LV sides with additional intermediate ventilation paths, instead of with increased electric field strengths. These air pathway inserts, to and between the cores, which improve the field gradients, are used in order that reliable insulation configurations are also present in the exterior of the transformer.

With these measures, otherwise normally used casting electrodes or surface leakage coverings in and on the housings can be eliminated.

For this reason, series circuitries made of air-plastic-air barriers are also universally place outside of the HV or LV junction boxes, in that these voltage reducing barriers are installed around the HV primary contacts 76, 39, via the positions 20, 21, 22 on the inner surfaces of the junction boxes and over the HV air arcing distance spacing 22 to the cores covered by frames.

This extreme space compression concept enables densely structured MF transformer cascades, FIG. 10, for transformers free of electric are nadirs over their entire surface area. With spatial configurations as well, and particularly in LV regions, for which the bushing grommets 23 are designed so as to be mirror reversed, subsequent insulating and bushing walls 133, 134 in substantially MS-condensed cascade configurations can be condensed.

The major advantage of these bushing designs, integrating junction boxes with, e.g. a medium voltage separating wall, are executed such that the HV-LV MF transformers do not need to be installed in the HV portion of the transformation converters, but instead, can also be incorporated in the LV spaces or chambers, see FIGS. 10A-10I. For this reason, the direct HV application to an insulation bulkhead 133, 134, FIG. 10C, is possible, because HV double insulation grommets 23, FIGS. 1 and 2 function with very short, high-voltage resistant tube-cone bridging lengths.

The cores 45, 46 are retained in the interior with the transformer and cover housings and the elastically compressible plate substrata 49 such that the core weights and vibrational forces to the elastic plate substrata 49 clamp the cover and transformer housing, FIGS. 1, 2, 12A-12C, 13, acting axially with the core frames 50, 51, which likewise rest in the interior on the intermediate plates 49, and, via the frame components 50 or 51, are screwed thereto.

The axial tensioning device for the core is depicted in the FIGS. 15A-15C, as is the anchoring of the cores. The cores 45 are tightened in cast fittings onto the transformer and cover housings by means of threaded rods, nuts 58 and tension springs 79, 80, in that the frame components 50, 51 are pressed together in the axial direction. Previously, tensioning bolts were normally provided on the exterior of the transformer housing for tightening the cores together. These tensioning bolts usually formed galvanic bridges between the low-voltage and high-voltage sides of the transformer. With the transformer according to the invention, cast fittings 73 are disposed on the housing with MS voltage levels. Anchoring bolts are tightened into the cast fittings 73, which tighten the tensioning frame 50, 51 to those of the cores 45, and retain them 79, 80.

In FIG. 16, the connection of the frame components 50, 51 to a metal rod 53, 54 is shown, which, however, can be exchangeable, as a cooler through which insulating liquid 87-91 or air or gas 106, 107 can flow.

Vertical cast fittings 130 in a front view of the MF transformer, FIGS. 11A-11D, 14A-14D, enable, alternatively, the attachment in converter housings, primarily on bushing walls as well, FIG. 10A-10I, made of plastic or, with separate transformer assembly screws, on bushing walls, to form transformer cascades, FIG. 10A-10I.

LIST OF REFERENCE SYMBOLS

1 secondary winding chamber, inner
2 primary winding chamber, middle
3 secondary winding chamber, outer
4 secondary housing wall, inner
5 primary separating wall, middle, inner
6 primary separating wall, middle, outer
7 secondary housing wall, outer
8 reinforcing ribs, transformer housing
9 bushings to the windings
10 tube fittings in cover housing
11 HV junction box
12 HIV lid and junction box
13 HV insulating seal between junction box and lid
14 HV grommet for the transformer junction box and optional bulkhead bushing, respectively
15 kidney-shaped hole in transformer and cover housing
16 HV GU cable connection
17 LV junction box
18 LV lid on junction box
19 LV insulating seal between junction box and lid
20 HV air spacing, primary fitting to HV inner wall
21 LV air spacing, secondary to LV inner wall
22 HV to LV arcing distance accumulation 20, 21 via insulating seal
23 HV grommet cone for bushing in converter housing
24 LV junction box secondary circuitry winding
25 HV lid screw connection-pressure to seals
26 HV screw connection for front surface pressure to grommet cone
27 LV screw connection for lid-seal pressure
28 LV insulating seal between junction box—lid
29 material recess in transformer/cover housing
30 primary/secondary bushings, e.g. casting resin in cast sleeves 37
31 secondary winding, inner, outer
32 primary winding with converter (GU) winding
33 gate, only converter (GUI) winding
34 intermediate insulation, converter to primary winding
35 metal foil with strands between $1^{st}$ and $2^{nd}$ layer
36 converter (GU) connection on bushing fitting
37 contact sleeve for accommodating the bushing
38 solder pocket on bushing fitting
39 annular contact for primary, secondary and converter (GU) connections
40 annular contact screw connection
41 connection of windings and windings
42 recesses
43 insulating material recess hollow space in converter (GU) junction box
44 thermo-conductive foil as intermediate insulation for cores
45 cores
46 tensioning strap cores
47 electrical connection of cores via tensioning straps, optional version
48 free-floating cores, standard design
49 elastic plate substrata, core to transformer and cover housings
50 frame component 1 "upper"
51 frame component 2 "lower"
52 accommodation space frames for cooler or connecting rod
53 cooler for heat dissipation in core layer region
54 connecting rod, for surface cooling of cores
55 frame ribs, electricity arcing distance extension
56 pressure accommodating fitting for core tension
57 tensioner fitting
58 tensioner nut for tensioner
59 hydraulic connections, single, feed, discharge
60 hydraulic connections, hydraulic bridges primary-secondary
61 tensioning flanges of the hydraulic bridges
62 gimbal disk between transformer/cover housing and lid
63 O-seal for hydraulic flange and bridges
64 cone hole for bushings in transformer housing and lid
65 narrow flange hole, transformer/cover housing
66 narrow flange-tensioning strap pressure, by means of cores
67 force-locking sleeve, cover housing
68 chamber seal 1
69 chamber seal 2
70 chamber seal 3
71 chamber seal 4
72 seal for bushings in cone hole 64
73 cast fitting, main flange
74 cast fitting, junction box, lid
75 cast fitting, liquid insulation seal
73 cast fitting, for core and anchoring bolts
74 cast fitting, tensioning block
75 tensioning disks for tightening main flange, housing
76 primary-secondary screw connection contacts
77 blocking disk for annular contacts
78 blocking disk for junction lid
79 tension spring for core tension
80 tension spring for tightening core tension
85 screw connection for hydraulic connection
86 screw connection for hydraulic bridges
87 liquid insulation ester
88 liquid insulation transformer oil
89 liquid insulation pure water with glycol
90 liquid insulation cooling agent

91 capacitor liquid insulation as substitution 87-90
92 strand windings to bushing+generic term for 31, 32
93 secondary chamber wall, inner with constriction
94 secondary chamber wall, outer with constriction
95 waves in chamber walls
96 strand retainer with waves in chamber walls
97 liquid insulation space
98 axial spacing of winding
99 groove base in cover housing
100 casting resin adhesive
101 adhesive level
102 Heightening of separating wall if only adhesive connection of housing is used, i.e. seals are omitted, "one-piece transformer housing" is obtained with chambers 1-3 sealed on all sides (aside from one discharge path for liquid insulation and sealed cone holes 64)
103 oil channel, primary, secondary, in housing integrated design
104 adhesive connection of transformer/cover housings, without seals
105 extension space corners, groove base for chamber seals 68-71
106 insulating gas $SF_6$ and cooling agent gas as insulating and cooling gas
107 pressurized air as insulating and cooling gas
108 width reduction measures, MF transformer
109 rubber rod spacer in housing lid; secondary winding
110 spacing bar, housing lid, single pressure: to primary winding
111 seal: bushing sleeve 37, coated with resin in housings
112 current contact bushings—bushing sleeves
113 bar-groove locking mechanism between bushings and bushing sleeves
114 pressure readjustment of lid on junction boxes
115 wave tensioning element for windings, alternative to waves 95, 96
116 trapezoid winding anchors in separating walls
117 contact sleeve—current transition surface annular contact, cable
118 converter (GU) connections
119 compression HV, LV lid seals
120 five-chamber housing for, e.g. primary/secondary double layers
121 inner wall I—secondary windings to ground
122 separating wall II—LV secondary to HV primary
123 separating wall III—HV primary to LV secondary, outer
124 separating wall IV—LV secondary, outer, to ground
125 multiple MF transformers in central housing outer wall to earth
126 attachment fitting
127 core cross-section, standard
128 core cross-section, enlarged
129 winding waves or trapezoid winding clip
130 winding retainer, plastic thin-wall part, without binding
131 HV connection cable
132 LV connection cable
133 HV bulkhead
134 HV bulkhead, insulating seal
200 transformer housing
201 cover housing

The invention claimed is:

1. A medium frequency transformer, comprising a sealed housing made of an insulating material, having a plurality of winding chambers for accommodating a plurality of windings, comprising a primary winding and a secondary winding, and at least one core, wherein a liquid or a gas insulating medium is placed in the winding chambers of the sealed housing which fills the winding chambers, provided with a plurality of bushing holes to the winding chambers, and a plurality of intakes and discharges for the insulating medium, and wherein the winding chambers are formed such that only the windings are surrounded by the insulating medium, whereas the core is disposed outside of the sealed housing filled with the insulating medium.

2. The medium frequency transformer according to claim 1, wherein the winding chambers are sealed and separated from one another by a plurality of insulating housing walls and separating walls, the windings are positioned in the winding chambers and fixed in place therein, and the winding chambers are filled with the liquid or the gas insulating medium.

3. The medium frequency transformer according to claim 1, wherein the housing is designed as at least a two-part housing prior to the assembly, comprising a transformer housing a cover housing, and a plurality of junction boxes and seals and lids that can be attached thereto.

4. The medium frequency transformer according to claim 1, wherein the windings are axially and radially fixed in place in the winding chambers.

5. The medium frequency transformer according to claim 2, wherein the housing walls and the separating walls exhibit a plurality of integrated projections or separate spacing elements through which the windings are positioned and fixed in place in the winding chambers, wherein the windings are positioned and fixed in place through a plurality of rigid or elastic components in the winding chambers.

6. The medium frequency transformer according to claim 2, wherein the transformer housing comprises the housing walls and the separating walls, and the cover housing exhibits a plurality of grooves, in which a plurality of outer walls and the separating walls engage in a sealing manner when sealing the transformer housing.

7. The medium frequency transformer according to claim 3, wherein, for connecting the transformer housing to the cover housing and the lids of the junction boxes, the transformer further comprises an attachment means with spring elements, which connect the cover housing and the lids to the transformer housing in a self-tightening manner.

8. The medium frequency transformer according to claim 1, further comprising, in the housing, a plurality of liquid and solid matter insulated, and electro-conductive, bushings, with which a plurality of ends of the windings, and a plurality of outer connections for the windings are electrically connected.

9. The medium frequency transformer according to claim 1, wherein a plurality of junction lids are disposed on the housing and connected to the housing in a compressed, and without gaps, insulating manner, and form insulated, or sealed, bushings for the connections of the windings.

10. The medium frequency transformer according to claim 1, wherein the at least one core is tensioned on a corner configuration and a recess of the housing and is retained and separated from the housing by means of a tensioning elastic intermediate layer.

11. The medium frequency transformer according to claim 1, wherein the at least one core is retained radially and axially by means of a plurality of tensioning straps and tensioning frames, and the at least one core is provided with ribs on the sides of a plurality of junction boxes and a plurality of outer surfaces of a core package for bridging components and thus to increase the electrical surge voltage resistance of the cores on the outside.

12. The medium frequency transformer according to claim 1, wherein the at least one core is grounded by means of a plurality of electrical connections to a plurality of tensioning straps, in order that a galvanic potential separation is obtained between an outer high-voltage connection and a low-voltage connection of the transformer.

13. The medium frequency transformer according to claim 1, wherein a plurality of material recesses are provided on a plurality of forms on the housing, for attaching the at least one core.

14. The medium frequency transformer according to claim 1, wherein an axially disposed intermediate insulation is disposed between the at least one core.

15. The medium frequency transformer according to claim 1, wherein a plurality of tensioning frames for accommodating the least one core is designed such that at least a partial cooling of the at least one core by means of the insulating liquid or through a plurality of cooling bodies integrated therein.

16. The medium frequency transformer according to claim 1, wherein the primary winding comprises two or more layers, wherein a sub-winding with an intermediate insulation is sandwiched between the layers of the primary winding.

17. The medium frequency transformer according to claim 1, wherein the winding chambers exhibit at least an intake and a discharge for the insulating liquid, wherein the insulating liquid is substantially conveyed in a uniform manner through the winding chambers.

18. The medium frequency transformer according to claim 17, wherein the intake of one winding chamber is connected to the discharge of another winding chamber via a hydraulic bridge connection wherein the hydraulic bridge is either integrated in the housing or is designed as a separate component and connected to the housing.

19. The medium frequency transformer according to claim 17, wherein the intakes and discharges in the housing comprise angled channels.

20. The medium frequency transformer according to claim 17, wherein the intakes and the discharges for the insulating liquid comprise hydraulic or pneumatic couplings.

21. The medium frequency transformer according to claim 1, wherein the housing of the transformer exhibits a plurality of fittings of uniform size on an upper surface and a lower surface, such that numerous such transformers can be connected, insulated in all layers, and be stacked directly on top of one another.

22. A plurality of medium frequency transformers according to claim 1 combined to form a plurality of cascades or partial cascades, and these are combined such that they form a collective housing with a collective configuration in multiple-units.

23. The medium frequency transformer according to claim 17, wherein the intake and the discharge for the insulating liquid are disposed on the housing diagonally opposed to one another.

24. The medium frequency transformer according to claim 19, wherein the angled channels are placed axially in the housing and enter the winding chambers radially.

25. The medium frequency transformer according to claim 20, wherein the couplings comprise self-sealing quick couplings made of electrically insulating material.

26. The medium frequency transformer according claim 2, wherein the housing is designed as a least two-part housing prior to the assembly, comprising a transformer housing, a cover housing, and a plurality of junction boxes and seals and lids that can be attached thereto.

27. The medium frequency transformer according to claim 26, wherein the transformer housing and its housing walls and separating walls are glued or cast to the cover housing.

* * * * *